US010741153B2

(12) United States Patent
Tanida et al.

(10) Patent No.: US 10,741,153 B2
(45) Date of Patent: Aug. 11, 2020

(54) INSTRUMENT PEDAL DEVICE

(71) Applicant: Roland Corporation, Shizuoka (JP)

(72) Inventors: Ryo Tanida, Shizuoka (JP); Kiyoshi Yoshino, Shizuoka (JP)

(73) Assignee: Roland Corporation, Shizuoka (JP)

( * ) Notice: Subject to any disclaimer, the term of this patent is extended or adjusted under 35 U.S.C. 154(b) by 20 days.

(21) Appl. No.: 16/070,292

(22) PCT Filed: Jan. 6, 2017

(86) PCT No.: PCT/JP2017/000226
§ 371 (c)(1),
(2) Date: Aug. 21, 2018

(87) PCT Pub. No.: WO2017/126335
PCT Pub. Date: Jul. 27, 2017

(65) Prior Publication Data

US 2019/0066646 A1 Feb. 28, 2019

(30) Foreign Application Priority Data

Jan. 19, 2016 (JP) ..... 2016-007793

(51) Int. Cl.
*G10H 1/34* (2006.01)
*G10D 13/00* (2020.01)
*G10H 1/32* (2006.01)

(52) U.S. Cl.
CPC ..... *G10H 1/348* (2013.01); *G10D 13/00* (2013.01); *G10H 1/32* (2013.01)

(58) Field of Classification Search
CPC ..... G10D 13/006; G10D 1/32; G10H 1/348
(Continued)

(56) References Cited

U.S. PATENT DOCUMENTS 2,540,051 A * 1/1951 Ludwig ..... G10D 13/006 84/422.1
2,551,635 A * 5/1951 Ramsey ..... G10D 13/006 84/422.1

(Continued)

FOREIGN PATENT DOCUMENTS

EP 2897125 7/2015
GB 725638 3/1955

(Continued)

OTHER PUBLICATIONS

"International Search Report (Form PCT/ISA/210)" of PCT/JP2017/000226, dated Mar. 14, 2017, with English translation thereof, pp. 1-3.

(Continued)

*Primary Examiner* — David S Warren
(74) *Attorney, Agent, or Firm* — JCIPRNET

(57) ABSTRACT

Provided is an instrument pedal device that can be quieter when operated. According to the present invention, a pedal is rotatably supported on a base part by a first shaft. A rotation part is rotatably supported on the base part by a second shaft. A connection part is rotatably supported on the pedal by a third shaft. The connection part is rotatably supported on the rotation part by a fourth shaft. Urging force that is for making the pedal, as rotated from an initial position, return to the initial position is applied by a spring. The pedal can rotate from the initial position to a lowermost position in which the second shaft, the third shaft, and the fourth shaft are in the same plane. The urging force of the spring increases the closer the pedal gets to the lowermost position.

4 Claims, 12 Drawing Sheets

(58) Field of Classification Search
USPC ..... 84/422.1, 422.2
See application file for complete search history.

(56) References Cited

U.S. PATENT DOCUMENTS

| | | | | |
|---|---|---|---|---|
| 4,200,025 | A * | 4/1980 | Currier | G10D 13/006 84/422.1 |
| 4,262,576 | A * | 4/1981 | Gorsky | G10D 13/006 84/422.1 |
| 5,301,592 | A * | 4/1994 | Johnston | G10D 13/006 84/422.1 |
| 6,684,734 | B2 * | 2/2004 | Gatzen | G10D 13/006 74/512 |
| 6,765,141 | B2 * | 7/2004 | Shigenaga | G10D 13/006 84/422.1 |
| 6,924,422 | B2 * | 8/2005 | Wise | G10D 13/006 84/422.1 |
| 7,197,957 | B2 * | 4/2007 | Gatzen | G10D 13/006 74/560 |
| 7,405,352 | B2 * | 7/2008 | Dorfman | G10D 13/006 84/225 |
| 7,456,351 | B2 * | 11/2008 | Dorfman | G10D 13/006 84/422.1 |
| 7,579,540 | B2 * | 8/2009 | Takegawa | G10D 13/006 84/422.1 |
| 8,278,541 | B2 * | 10/2012 | Dorfman | G10D 13/006 84/422.1 |
| 8,455,746 | B2 * | 6/2013 | Johnston | G10D 13/006 84/422.1 |
| 8,642,868 | B1 * | 2/2014 | Blashaw | G10D 13/006 84/422.1 |
| 8,686,265 | B2 * | 4/2014 | Johnston | G10D 13/006 84/422.1 |
| 8,927,844 | B2 * | 1/2015 | Kitching | G10D 13/006 84/422.1 |
| 9,589,546 | B2 * | 3/2017 | Sikra | G10D 13/006 |
| 2003/0159563 | A1 * | 8/2003 | Shigenaga | G10D 13/006 84/422.1 |
| 2003/0213329 | A1 * | 11/2003 | Gatzen | G10D 13/006 74/512 |
| 2004/0144198 | A1 * | 7/2004 | Gatzen | G10D 13/006 74/560 |
| 2005/0016358 | A1 * | 1/2005 | Wise | G10D 13/006 84/422.1 |
| 2006/0156900 | A1 * | 7/2006 | Dorfman | G10D 13/006 84/422.1 |
| 2006/0156901 | A1 * | 7/2006 | Dorfman | G10D 13/006 84/422.1 |
| 2007/0295191 | A1 * | 12/2007 | Dorfman | G10D 13/006 84/422.1 |
| 2012/0144976 | A1 * | 6/2012 | Johnston | G10D 13/006 84/422.1 |
| 2012/0174734 | A1 * | 7/2012 | Dorfman | G10D 13/006 84/422.1 |
| 2012/0198984 | A1 * | 8/2012 | Johnston | G10D 13/006 84/422.1 |

FOREIGN PATENT DOCUMENTS

| | | |
|---|---|---|
| JP | S4830183 | 9/1973 |
| JP | H0997075 | 4/1997 |
| JP | 2003-167574 | 6/2003 |
| JP | 2014081501 | 5/2014 |
| JP | 2015135512 | 7/2015 |

OTHER PUBLICATIONS

"Search Report of Europe Counterpart Application", dated Aug. 27, 2019, p. 1-p. 8.
"Office Action of Europe Counterpart Application", dated Apr. 8, 2020, pp. 1-4.

* cited by examiner

INSTRUMENT PEDAL DEVICE

CROSS-REFERENCE TO RELATED APPLICATION

This application is a 371 application of the international PCT application serial no. PCT/JP2017/000226, filed on Jan. 6, 2017, which claims the priority benefit of Japan application no. 2016-007793, filed on Jan. 19, 2016. The entirety of each of the abovementioned patent applications is hereby incorporated by reference herein and made a part of this specification.

TECHNICAL FIELD

The present invention relates to an instrument pedal device. Specifically, the present invention relates to an instrument pedal device capable of improving sound damping performance during an operation.

BACKGROUND ART

Instrument pedal devices are used to play or practice electronic instruments that simulate an acoustic bass drum, an acoustic high hat cymbal and the like. For example, there is an instrument pedal device in which a striking part is rotated in response to pushing of a pedal by a performer, and a striking part strikes a struck part (Patent Literature 1).

CITATION LIST

Patent Literature

[Patent Literature 1]
Japanese Unexamined Patent Application Publication No. 2014-81501

SUMMARY OF INVENTION

Technical Problem

However, if a striking part strikes a struck part when a pedal is operated (pushed), a striking sound and shock are generated. Therefore, when a play or practice is performed in an environment for which silence is required, a striking sound and shock cause problems.

The present invention has been made in order to address the above problems. An objective of the present invention is to provide an instrument pedal device capable of improving sound damping performance during operation.

Solution to Problem

In order to achieve the above objective, an instrument pedal device of the present invention includes a base part that is placed on a floor; a pedal of which a first end side is rotatably supported on the base part by a first shaft in a rotatable range of an initial position to a lowermost position; a rotation part that is rotatably supported on the base part by a second shaft that is parallel to the first shaft; a connection part that is rotatably supported on a second end side of the pedal by a third shaft that is parallel to the first shaft and is rotatably supported on the rotation part by a fourth shaft that is parallel to the first shaft; and a biasing member that applies an urging force to the pedal that has rotated from the initial position to return to the initial position, wherein the second shaft, the third shaft, and the fourth shaft are included in the same plane at the lowermost position, and wherein the urging force of the biasing member becomes larger as the pedal becomes closer to the lowermost position from the initial position.

Advantageous Effects of Invention

According to the instrument pedal device of claim 1, when a performer pushes (operates) the pedal, the pedal rotates around the first shaft in a rotatable range of an initial position to a lowermost position. The third shaft swings according to rotation of the pedal. Then, the rotation part rotates around the second shaft according to swinging of the third shaft. An urging force is applied to the pedal that has rotated from the initial position to return to the initial position by the biasing member. Therefore, the urging force of the biasing member becomes larger as the pedal becomes closer to the lowermost position from the initial position.

It is structurally impossible to push the pedal further from a position at which the second shaft, the third shaft and the fourth shaft are included in the same plane. Therefore, the position at which the second shaft, the third shaft and the fourth shaft are included in the same plane is the lowermost position of the pedal. Since a range of the initial position to the lowermost position is a rotatable range of the pedal, as in Patent Literature 1, when the struck part is struck in response to pushing of the pedal, rotation of the pedal is not stopped according to striking to the struck part. The pedal can be rotated to a limit of pushing by the performer. Therefore, it is possible to prevent a striking sound and shock from being generated when the struck part is struck as in Patent Literature 1. In addition, when the pedal is closer to the lowermost position, since the kinetic energy of the pedal can be reduced by the biasing member, it is possible to reduce the shock and sound when rotation of the pedal is stopped. As a result, the instrument pedal device has an effect of improving sound damping performance when the pedal is operated.

According to the instrument pedal device of claim 2, when the pedal is at the initial position, the fourth shaft is positioned on the side of the first shaft with respect to a plane including the second shaft and the third shaft. Thereby, in addition to the effects of claim 1, the instrument pedal device has an effect of reducing the size of the instrument pedal device compared to when the fourth shaft is positioned on the side opposite to the first shaft with respect to the plane including the second shaft and the third shaft.

The instrument pedal device of claim 3 includes a pedal sensor that receives a pressing force from the pedal during rotation from the initial position to the lowermost position and detects an operation state of the pedal. Rotation of the pedal to the lowermost position from a state in which a pressing force from the pedal is applied to the pedal sensor is allowed according to elastic deformation of an elastic body. Therefore, in the instrument pedal device, without disturbing rotation of the pedal by the elastic body, the pedal sensor can detect an operation state of the pedal. As a result, the instrument pedal device has an effect of improving sound damping performance when the pedal is operated and detecting pushing of the pedal by the pedal sensor in addition to the effects of claim 1 or 2.

According to the instrument pedal device of claim 4, the elastic body includes a first buffer component that is positioned between the pedal and the pedal sensor and a second buffer component that is positioned between the pedal sensor and the base part. In the instrument pedal device, since shock and vibration transmitted when the pedal is operated from the pedal to the pedal sensor can be reduced by the first buffer component, it is possible to improve sound damping performance when the pedal is operated.

In the instrument pedal device, shock and vibration transmitted from the base part to the pedal sensor can be reduced by the second buffer component. Therefore, it is possible to reduce a pressing force received by the pedal sensor from the base part through the second buffer component, and erroneous detection of the pedal sensor can be reduced. Therefore, the instrument pedal device can improve sound damping performance when the pedal is operated and reduce erroneous detection of the pedal sensor in addition to the effects of claim 3.

According to the instrument pedal device of claim 5, the elastic body is provided between the pedal and the pedal sensor. The elastic body has an elastic modulus with which a force pressing the pedal sensor becomes larger as the pedal becomes closer to the lowermost position. Since the pedal sensor is a pressure sensor in which detection values change according to a pressing force, the instrument pedal device has an effect of detecting a push amount of the pedal in addition to the effects of claim 3.

DESCRIPTION OF EMBODIMENTS

Figure 1:
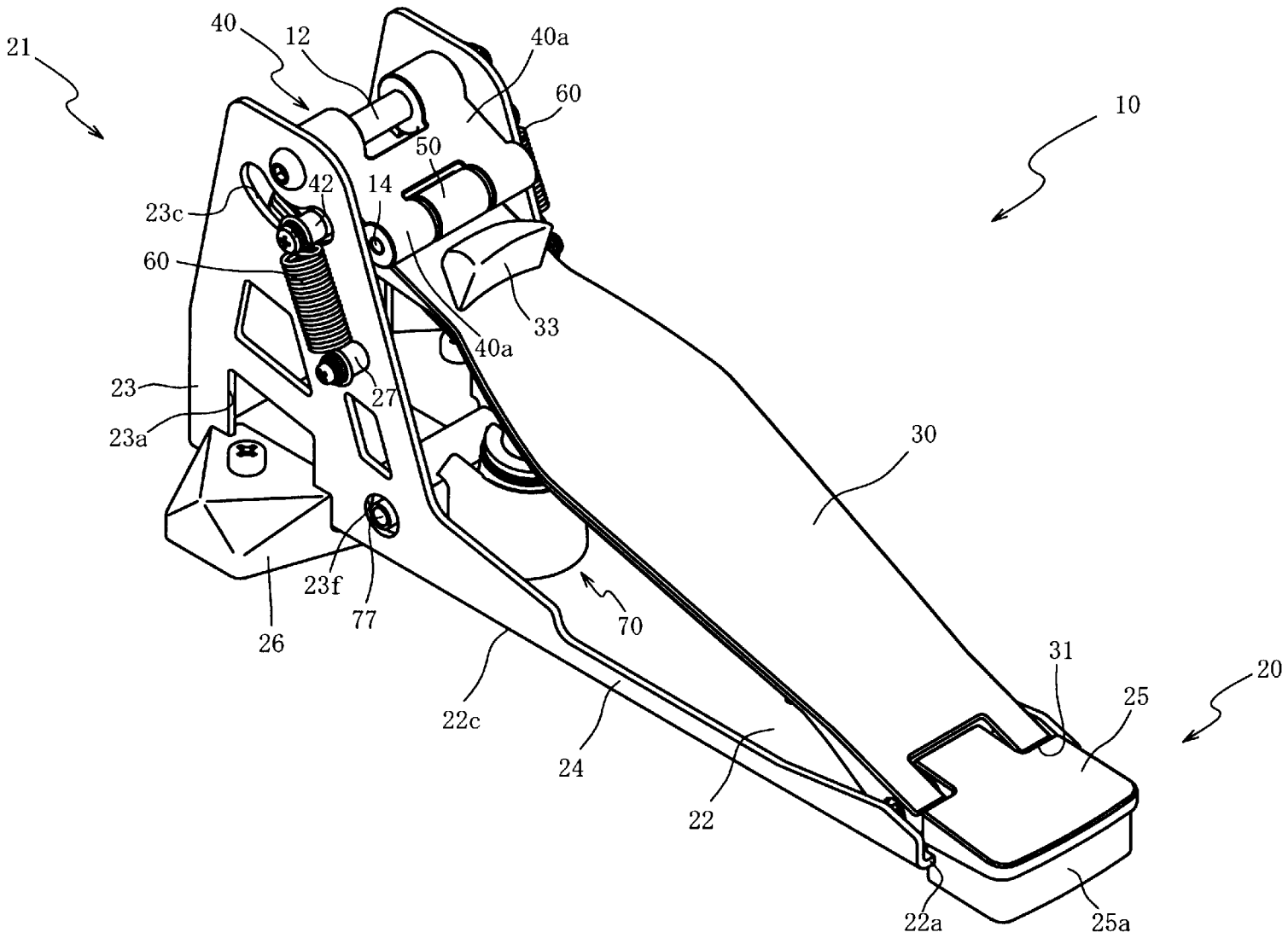
FIG. 1 is a perspective view of an instrument pedal device according to a first embodiment of the present invention.
Figure 2:
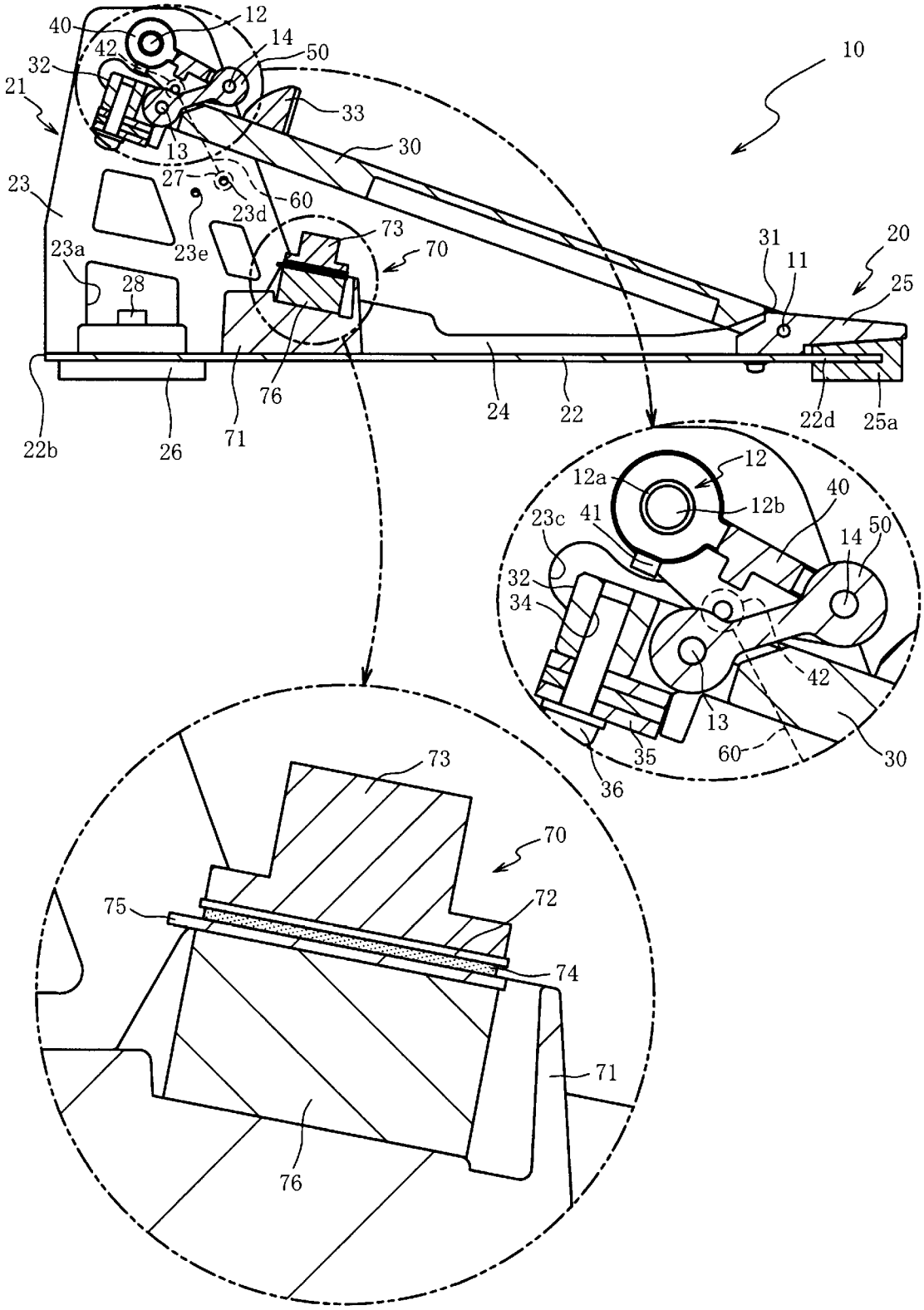
FIG. 2 is a cross-sectional view of the instrument pedal device, which shows an initial position of a pedal.

Preferable embodiments of the present invention will be described below with reference to the accompanying drawings. First, a schematic configuration of an instrument pedal device (hereinafter referred to as a "pedal device") 10 in a first embodiment of the present invention will be described with reference to FIG. 1 and FIG. 2. FIG. 1 is a perspective view of the pedal device 10 in the first embodiment of the present invention. FIG. 2 is a cross-sectional view of the pedal device 10, which shows an initial position of a pedal 30. The right side of the plane of the paper in FIG. 2 will be described as the front side of the pedal device 10. In front of the plane of the paper in FIG. 2 will be described as the left side of the pedal device 10. The upper side of the plane of the paper in FIG. 2 will be described as above the pedal device 10. Here, the initial position of the pedal 30 refers to a position of the pedal 30 when a performer is not pushing the pedal 30 (not operating).

As shown in FIG. 1 and FIG. 2, the pedal device 10 is a device for playing an electronic instrument which simulates a percussion instrument such as a bass drum of which a struck surface is struck by an operation of the pedal. The pedal device 10 includes a base part 20, the pedal 30, a rotation part 40, a connection part 50, a spring 60 (biasing member), and a sensor unit 70. The pedal 30 is rotatably supported on the base part 20 by a first shaft 11. The rotation part 40 is rotatably supported on the base part 20 by a second shaft 12. The connection part 50 is rotatably supported on the pedal 30 by a third shaft 13. The connection part 50 is rotatably supported on the rotation part 40 by a fourth shaft 14.

The first shaft 11, the second shaft 12, the third shaft 13, and the fourth shaft 14 are provided parallel to each other, and horizontally extend when the pedal device 10 is installed on the floor. These shafts are positioned in the order of the second shaft 12, the fourth shaft 14, the third shaft 13, and the first shaft 11 from above. When the pedal 30 is at the initial position, the fourth shaft 14 is positioned on the side of the first shaft 11 with respect to the plane including the second shaft 12 and the third shaft 13. Thereby, compared to when the fourth shaft 14 is positioned on the side opposite to the first shaft 11 from the plane including the second shaft 12 and the third shaft 13, it is possible to reduce the size of the pedal device 10.

The base part 20 is a member serving as a foundation of the pedal device 10. The base part 20 is formed by mounting a front ground part 25 and a rear ground part 26 on a plate-like frame 21. In the base part 20, the front ground part 25 and the rear ground part 26 come in contact with the floor and are placed on the floor.

The frame 21 is made of a single metal plate. The frame 21 includes a bottom panel 22 (bottom part), a side plate 23, and a rib 24. In the bottom panel 22, a side edge 22*c* extends from a first end 22*a* which is a front side end (the right side of the plane of the paper in FIG. 2) to a second end 22*b* which is a rear side end (the left side of the plane of the paper in FIG. 2).

The bottom panel 22 is a rectangular part constituting the bottom of the base part 20. The side plates 23 are a pair of parts constituting side surfaces of the base part 20. The side plate 23 rises from the side edge 22*c* on the side of the second end 22*b* of the bottom panel 22. The rib 24 is a part for ensuring the rigidity of the bottom panel 22 and is provided from the side plate 23 to the first end 22*a*. The rib 24 rises from the side edge 22*c* and is integrally formed with the side plate 23. Here, since a part of the pedal 30 protrudes outward from the side edge 22*c*, the height of the rib 24 is set such that it does not come into contact with the pedal 30 (refer to FIG. 6) at the lowermost position.

Figure 3:
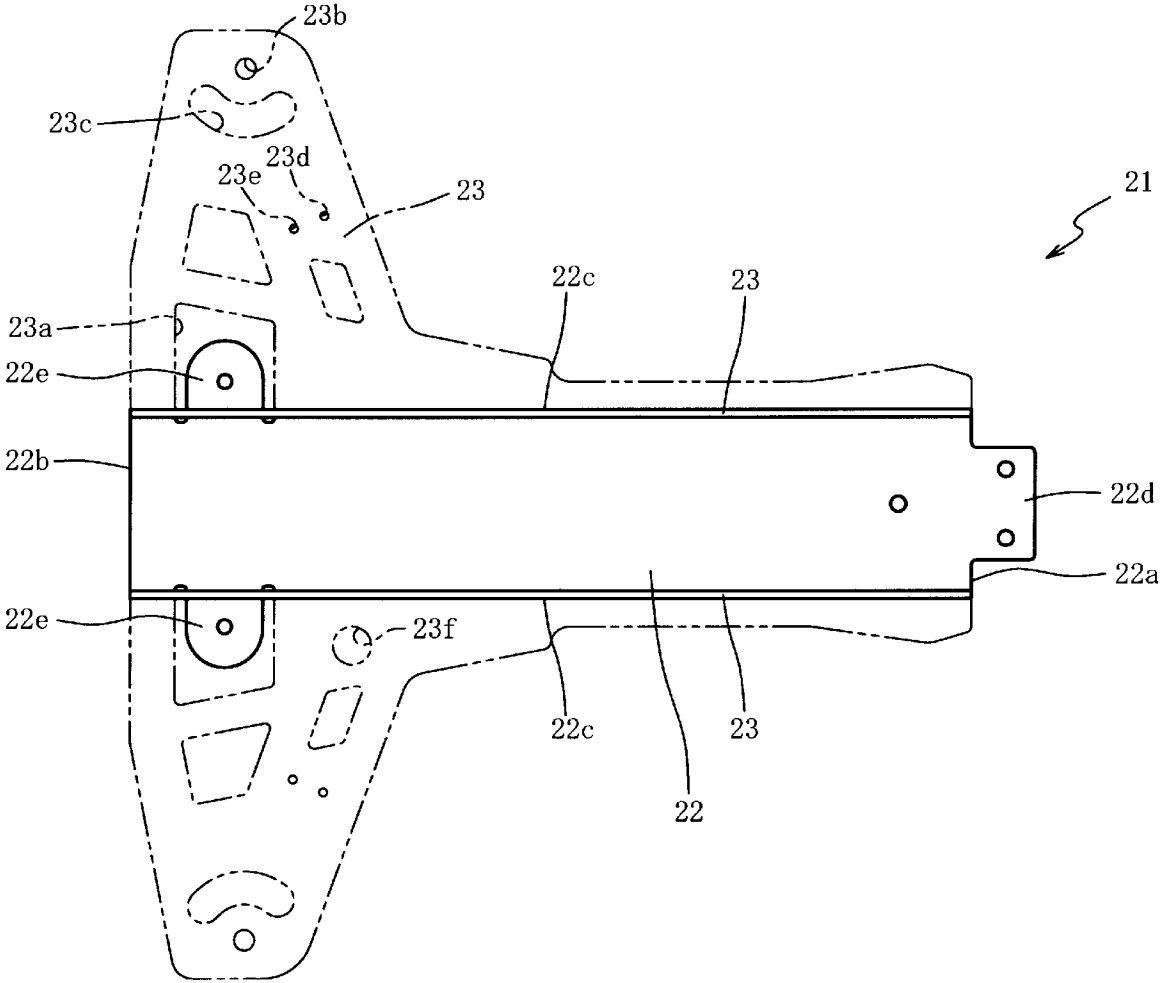
FIG. 3 is a plan view of a frame of the instrument pedal device.

Next, a method of producing the base part 20 will be described with reference to FIG. 3. FIG. 3 is a plan view of the frame 21 of the pedal device 10. Here, in FIG. 3, the side plate 23 before bending processing is indicated by a two dots-dashed line. As shown in FIG. 3, first, one plate having a shape in which a part corresponding to the side plate 23 indicated by a two dots-dashed line protrudes from the side edge 22*c* of the bottom panel 22 is prepared. In addition, in the one plate, a front mounting part 22*d* protrudes from the first end 22*a* of the bottom panel 22.

In the part corresponding to the side plate 23 of the one plate, a cutout hole 23*a* cut out from the side edge 22*c* is formed. Here, the cutout hole 23*a* is formed such that a leg 22*e* protruding from the side edge 22*c* of the bottom panel 22 remains inside the cutout hole 23*a*. In addition, in the part corresponding to the side plate 23 of one plate, a shaft hole 23*b*, a guide hole 23*c*, a first mounting hole 23*d*, a second mounting hole 23*e* and an output terminal hole 23*f* are drilled. Here, a process of forming an exterior shape of the one plate and a process of forming the holes 23*a*, 23*b*, 23*c*, 23*d*, 23*e*, and 23*f* can be simultaneously performed.

Next, when one plate is folded almost at a right angle at the side edge 22*c*, the pair of side plates 23 and the rib 24 are formed and the frame 21 is formed. In this manner, since the frame 21 (the base part 20) can be easily formed, the pedal device 10 can be easily produced. Finally, the front ground part 25 (refer to FIG. 2) is mounted on the front mounting part 22*d* of the frame 21, the rear ground part 26 (refer to FIG. 2) is mounted on the leg 22*e*, and the base part 20 is formed.

In addition, when one plate is subjected to bending processing, the side plate 23 is formed by folding the one plate except for the inside of the cutout hole 23*a*, and thereby the leg 22*e* can be easily formed. In addition, in a state before bending processing is performed, the cutout hole 23*a* is provided such that a predetermined gap is formed between the side plate 23 and the leg 22*e*. That is, the size of the leg 22*e* is set to be smaller than the size of the cutout hole 23*a*. Thereby, when bending processing is performed, the side plate 23 and the leg 22*e* can be easily separated. Here, without providing a gap between the side plate 23 and the leg 22*e* in a state before bending processing is performed, the size of the leg 22*e* and the size of the cutout hole 23*a* can be set to be substantially equal to each other.

Next, a detailed configuration of the pedal device 10 will be described with reference to FIG. 1 to FIG. 3. In the bottom panel 22, the leg 22*e* protrudes from the side edge 22*c* at a position corresponding to the cutout hole 23*a* outward in the left and right direction. The size of the leg 22*e* is formed to be equal to or smaller than the size of the cutout hole 23*a*. Since the leg 22*e* protrudes from the side edge 22*c* outward in the left and right direction, the pedal device 10 does not easily fall down, and the stability of the pedal device 10 can be ensured.

In each of the pair of side plates 23, the cutout hole 23*a* is provided upward from the side edge 22*c* of the bottom panel 22. In each of the pair of side plates 23, the shaft hole 23*b* that penetrates through the upper end (end distant from the bottom panel 22) side is provided. In each of the pair of side plates 23, the guide hole 23*c* that extends in the circumferential direction around the shaft hole 23*b* is provided. The output terminal hole 23*f* for exposing an output terminal 77 of the sensor unit 70 is provided in one of the pair of side plates 23.

A first mounting part 27 is mounted on either of the first mounting hole 23*d* or the second mounting hole 23*e*. The spring 60 is mounted on the first mounting part 27. The pedal 30 at the initial position is set to be closer to the bottom panel 22 when the first mounting part 27 is mounted on the second mounting hole 23*e* than when the first mounting part 27 is mounted on the first mounting hole 23*d*. Here, in the present embodiment, the first mounting part 27 is mounted on the first mounting hole 23*d*.

In the pair of side plates 23, the second shaft 12 extends through the shaft hole 23*b*. Thereby, since the pair of side plates 23 do not easily fall down in directions that are opposite to each other, the strength and rigidity of the pair of side plates 23 can be ensured.

The second shaft 12 includes a pipe 12*a* and a bolt 12*b*. The pipe 12*a* is a metal member having a length the same as an interval between the pair of side plates 23. The outer diameter of the pipe 12*a* is formed to be larger than the diameter of the shaft hole 23*b*. The bolt 12*b* is a member that is inserted into the shaft hole 23*b* and the pipe 12*a*. As a result, an interval between upper end sides (near the second shaft 12) of the pair of side plates 23 is determined as the length of the pipe 12*a*.

The pipe 12*a* is disposed between the pair of side plates 23 such that the axis center of the shaft hole 23*b* is aligned with the axis center of the pipe 12*a*. In this state, the bolt 12*b* is inserted into the shaft hole 23*b* and the pipe 12*a*, and a nut (not shown) is mounted on the bolt 12*b*. Thereby, the pair of side plates 23 are connected to each other and the second shaft 12 is fixed to the pair of side plates 23. As a result, with respect to a force applied to the second shaft 12 and the pair of side plates 23 through the rotation part 40 in response to pushing of the pedal 30, it is possible to improve the strength and rigidity of a bonding part between the second shaft 12 and the pair of side plates 23, and the pair of side plates 23.

The front ground part 25 is a member which receives a load on the front side of the pedal device 10 and on which a heel of the performer is placed. The front ground part 25 supports the first shaft 11 through a sliding bearing (not shown). In the front ground part 25, a part that comes in contact with the floor is a rubber foot 25*a*.

The rear ground part 26 is a rubber member that receives a load on the rear side of the pedal device 10 and covers the leg 22*e*. The rear ground part 26 is inserted from the outside of the leg 22*e* in the left and right direction and the rear ground part 26 is inserted into the leg 22*e*. In this state, when a bolt 28 that penetrates through the leg 22*e* and the rear ground part 26 in the vertical direction is mounted, the rear ground part 26 is fixed to the leg 22*e*. According to the rubber foot 25*a* of the front ground part 25 and the rubber rear ground part 26, it is possible to reduce vibration and shock transmitted from the pedal device 10 to the floor.

The pedal 30 is a member that rotates around the first shaft 11 when a foot of the performer is put on the front side and the performer performs a push operation. The pedal 30 is formed in a long plate shape that extends from a first end 31 toward a second end 32. In the pedal 30, the first shaft 11 is fixed to the side of the first end 31 and the third shaft 13 is fixed to the side of the second end 32.

The pedal 30 includes a restriction part 33 and a bolt hole 34. The restriction part 33 is a part on which a toe of the performer is put and that restricts a foot from touching the rotation part 40 and the like. The bolt hole 34 is provided closer to the second end 32 than the third shaft 13. A bolt 36 that penetrates through three plate-like weights 35 is fastened to the bolt hole 34. Thereby, the weight 35 is mounted on the side of the second end 32 of the pedal 30. Since an inertial force when the pedal 30 is pushed can be increased by the weight 35, an operation feeling of the pedal 30 can be improved. Here, the number of weights 35 and shapes thereof can be appropriately changed, and the operation feeling can be changed according to the total weight of the weights 35.

Figure 4:
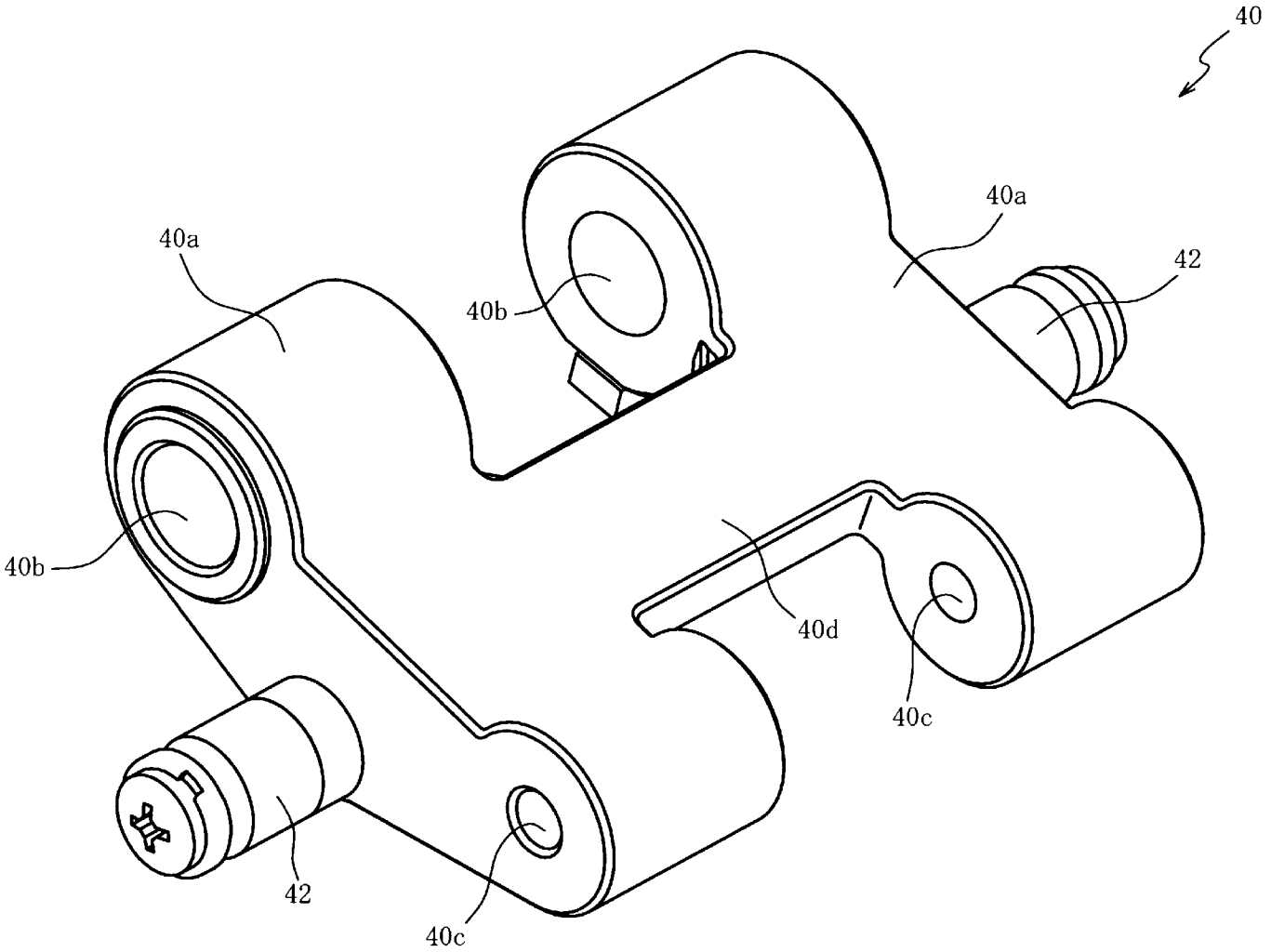
FIG. 4 is a perspective view of a rotation part.

Next, the rotation part 40 will be described with reference to FIG. 4. FIG. 4 is a perspective view of the rotation part 40. As shown in FIG. 4, the rotation part 40 includes a pair of rotating main bodies 40*a* and a linking part 40*d*. The rotation part 40 is made of a composite material obtained by combining glass fibers with a nylon resin and has a self lubricating property. The pair of rotating main bodies 40*a* are rod-like parts including one end at which a through-hole 40*b* is formed and the other end at which a through-hole 40*c* is formed. In the pair of rotating main bodies 40*a*, a second mounting part 42 that extends in the axial direction of the through-holes 40*b* and 40*c* is provided to protrude outward from a gap between the through-hole 40*b* and the through-hole 40*c*. The linking pail 40*d* is a part that connects the insides of the pair of rotating main bodies 40*a* to each other in the axial direction of the through-holes 40*b* and 40*c*.

Description will now return to FIG. 1 to FIG. 3. The rotation part 40 is a member that rotates around the second shaft 12 in response to pushing of the pedal 30. The second shaft 12 (the bolt 12*b*) is inserted into the through-hole 40*b* (refer to FIG. 4) and the rotation part 40 is rotatable with respect to the second shaft 12. The fourth shaft 14 that is a metal shaft is press-fitted into the through-hole 40*c* (refer to FIG. 4) of the rotation part 40.

The second mounting part 42 is inserted into the guide hole 23*c* and an end of the second mounting part 42 protrudes to the outside from a gap between the pair of side plates 23. In this state, the spring 60 is mounted on the end of the second mounting part 42. Here, the second mounting part 42 moves in the guide hole 23*c* according to rotation of the rotation part 40.

At the initial position of the pedal 30, the rotation part 40 is slightly separated from the pedal 30. In the rotation part 40, a cushion 41 is provided at a position at which there is a risk of contact with the pedal 30. When the pedal 30 rotates upward from the initial position, the cushion 41 can reduce a striking sound and shock due to contact between the pedal 30 and the rotation part 40.

The connection part 50 is a member that connects the pedal 30 and the rotation part 40 through the third shaft 13 and the fourth shaft 14. The connection part 50 is a rod-like member having a width substantially the same as an interval between the pair of rotating main bodies 40*a*. At both ends of the rod-like member, a through-hole (not shown) into which the third shaft 13 and the fourth shaft 14 are inserted is formed. The connection part 50 is made of a composite material obtained by combining glass fibers with a nylon resin and has a self lubricating property. One end of the connection part 50 penetrates through the third shaft 13 and is rotatable with respect to the third shaft 13. In addition, the other end of the connection part 50 penetrates through the fourth shaft 14 and is rotatable with respect to the fourth shaft 14.

The spring 60 is a tension coil spring that connects the first mounting part 27 and the second mounting part 42. The spring 60 applies an urging force to the pedal 30 to return the rotated pedal 30 to the initial position. The spring 60 is provided on both left and right sides of the pedal device 10. The spring 60 is provided outside a gap between the pair of side plates 23. Compared to when the spring 60 is provided between the pair of side plates 23, it is possible to reduce the size of the pair of side plates 23 in the facing direction. In addition, it is possible to secure a space for the rotation part 40, the connection part 50, and the pedal 30 provided between the pair of side plates 23. As a result, it is possible to reduce the size of the pedal device 10, set the sizes of the rotation part 40, the connection part 50 and the pedal 30 to be large, and improve the rigidity and strength of the rotation part 40, the connection part 50, and the pedal 30.

While an urging force is applied, the spring 60 connects the first mounting part 27 and the second mounting part 42. Thus, while the pedal 30 is not pushed (the initial position of the pedal 30), the rotation part 40 can be stopped at a predetermined position so that a distance from the first mounting part 27 to the second mounting part 42 is the shortest. Here, the distance is the shortest when the second mounting part 42 is positioned on a line connecting the second shaft 12 and the first mounting part 27 in a side view (when viewed in the axial direction of the second shaft 12). In addition, when the rotation part 40 is stopped, the connection part 50 that is rotatably supported on the rotation part 40 is stopped at a predetermined position and the pedal 30 that is rotatably supported on the connection part 50 can be stopped at the initial position.

In practice, at the initial position of the pedal 30, according to a relationship between an own weight of the pedal 30, the rotation part 40, the connection part 50, or the like and an urging force of the spring 60, the second mounting part 42 is positioned slightly below the position (the line connecting the second shaft 12 and the first mounting part 27) at which a distance from the first mounting part 27 is the shortest in a side view. However, for simplicity of description, in this specification, it is described that a distance from the first mounting part 27 to the second mounting part 42 is the shortest at the initial position of the pedal 30.

The sensor unit 70 is a member that detects an operation state of the pedal 30. The sensor unit 70 includes a main body 71, a pedal sensor 72, a first buffer component 73 (elastic body), a double-sided adhesive tape 74, a sheet metal 75, and a second buffer component 76 (elastic body).

The main body 71 is a member that is mounted on a surface on the side of the pedal 30 of the bottom panel 22. In the main body 71, the output terminal 77 configured to output a detection result of the pedal sensor 72 to an external device (not shown) is provided. The pedal sensor 72 is a disk-like vibration sensor including a piezoelectric sensor and mainly detects deformation in the plate thickness direction. The pedal sensor 72 receives a pressing force from the pedal 30 and detects an operation state of the pedal 30.

The first buffer component 73 and the second buffer component 76 are members made of sponge. The first buffer component 73 is a hat-like member that is adhered to a surface on the side of the pedal 30 of the pedal sensor 72. The second buffer component 76 is a cylindrical member of which both end surfaces are adhered to the sheet metal 75 and the main body 71. The disk-like double-sided adhesive tape 74 having a cushioning property is adhered to a surface on the side of the bottom panel 22 of the pedal sensor 72. The pedal sensor 72 is adhered to the sheet metal 75 through the double-sided adhesive tape 74. Since the second buffer component 76 is provided between the pedal sensor 72 and the bottom panel 22, it is possible to reduce vibration and shock transmitted from the bottom panel 22 to the pedal sensor 72. Thereby, erroneous detection of the pedal sensor 72 can be reduced. Here, the first buffer component 73 and the second buffer component 76 can be made of rubber, a thermoplastic elastomer, a felt or the like.

The sheet metal 75 is a member for ensuring the detection sensitivity of the pedal sensor 72. The pedal sensor 72 is interposed between the first buffer component 73 and the second buffer component 76 which can be deformed relatively greatly. Thus, the pedal sensor 72 may not be easily deformed and deformation of the pedal sensor 72 may be complicated. However, the sheet metal 75 is provided between the pedal sensor 72 and the second buffer component 76, and the pedal sensor 72 is adhered to the sheet metal 75 using the double-sided adhesive tape 74. As a result, it is possible to deform the pedal sensor 72 using the double-sided adhesive tape 74 and stabilize deformation of the pedal sensor 72 using the sheet metal 75 as a base. Thus, it is possible to ensure the detection sensitivity of the pedal sensor 72.

Here, the sheet metal 75 is provided between the pedal sensor 72 and the first buffer component 73, and the pedal sensor 72 can be adhered to the sheet metal 75 using the double-sided adhesive tape 74. Also in this case, it is possible to deform the pedal sensor 72 using the double-sided adhesive tape 74 and stabilize deformation of the pedal sensor 72 using the sheet metal 75 as a base. As a result, it is possible to ensure the detection sensitivity of the pedal sensor 72.

Figure 5:
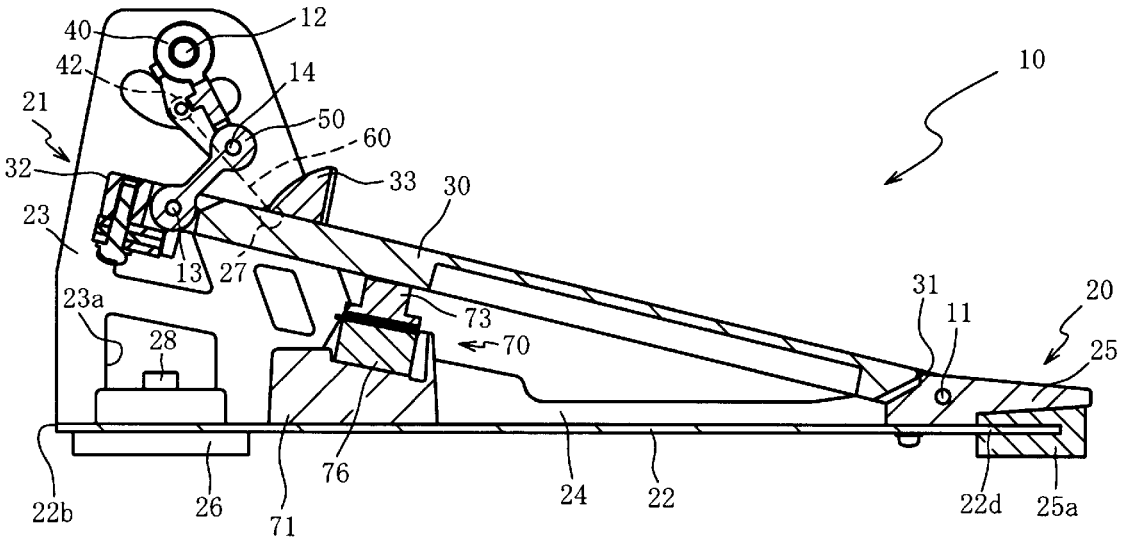
FIG. 5 is a cross-sectional view of the instrument pedal device, which shows a moment when a sensor unit and a pedal come in contact with each other.
Figure 6:
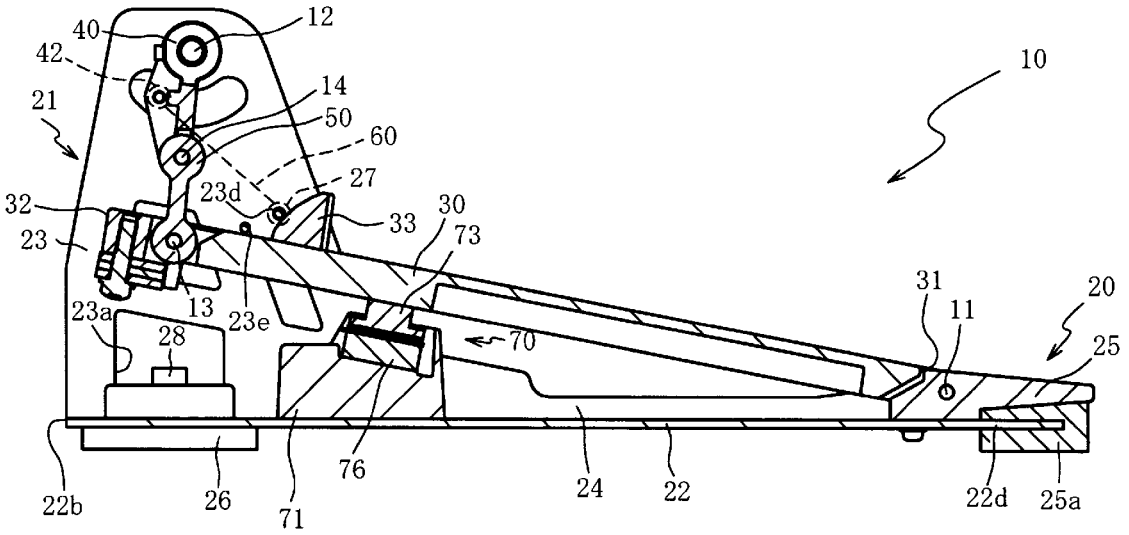
FIG. 6 is a cross-sectional view of the instrument pedal device, which shows the lowermost position of the pedal.
Figure 7:
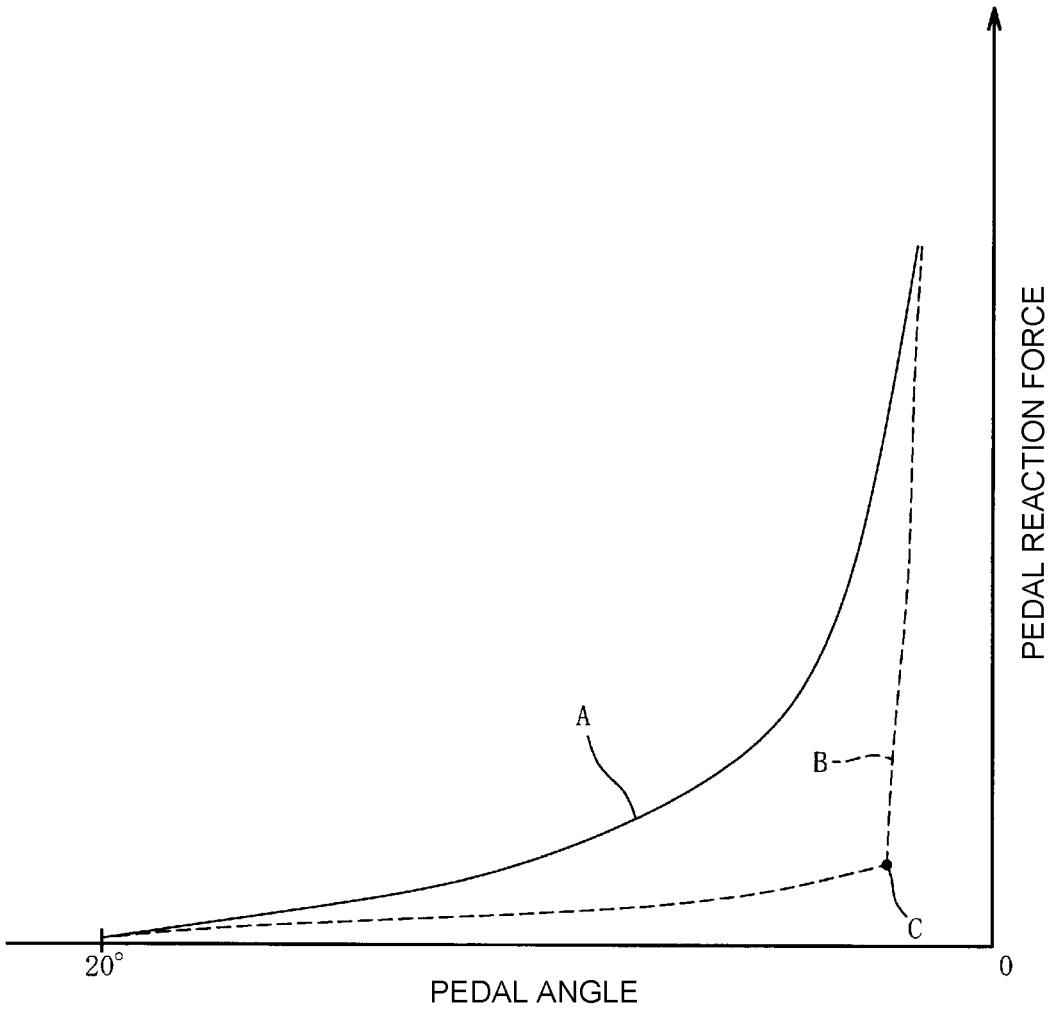
FIG. 7 is a graph schematically showing a pedal angle and a pedal reaction force.

Next, operations of the pedal device 10 will be described with reference to FIG. 2, FIG. 5, FIG. 6 and FIG. 7. FIG. 5 is a cross-sectional view of the pedal device 10, which shows a moment when the sensor unit 70 and the pedal 30 come in contact with each other. FIG. 6 is a cross-sectional view of the pedal device 10, which shows the lowermost position of the pedal 30. FIG. 7 is a graph schematically showing a pedal angle and a pedal reaction force. In FIG. 7, a graph A of a pedal angle and a pedal reaction force of the pedal device 10 is indicated by a solid line. In FIG. 7, a graph B of a pedal angle and a pedal reaction force of a conventional pedal device (for example, a pedal device in Patent Literature 1) that strikes a struck part according to rotation of the pedal is indicated by a dashed line. Here, the pedal angle is an angle of the pedal 30 with respect to the bottom panel 22 (floor) and becomes smaller as the pedal 30 is pushed more. The pedal reaction force is a reaction force (the urging force of the spring 60 or the like) applied to the performer from the pedal 30 when the pedal 30 is pushed.

When the performer pushes (operates) the pedal 30 at the initial position shown in FIG. 2, the pedal 30 rotates around the first shaft 11 in one direction (counterclockwise in FIG. 2). Then, the third shaft 13 is pushed downward according to rotation of the pedal 30. Thereby, the connection part 50 supported by the third shaft 13 is pushed downward. Then, the rotation part 40 supported on the connection part 50 by the fourth shaft 14 rotates around the second shaft 12 in one direction (clockwise in FIG. 2). In addition, when pushing of the pedal 30 is released, the rotation part 40 and the connection part 50 move in the opposite direction according to the urging force of the spring 60 and the pedal 30 is returned to the initial position. In this manner, the pedal device 10 constitutes a crank mechanism configured to rotate the rotation part 40 according to an operation of the pedal 30.

As shown in FIG. 5, when the performer pushes the pedal 30 and thus the pedal 30 and the sensor unit 70 (the first buffer component 73) come in contact with each other, a pressing force is applied to the pedal sensor 72 from the pedal 30 through the first buffer component 73. Accordingly, the pedal sensor 72 can detect the fact that the performer has pushed the pedal 30 by a predetermined amount. Since the pedal sensor 72 is a piezoelectric sensor, it can detect the strength of the shock or vibration when the pedal 30 and the sensor unit 70 come in contact with each other. Accordingly, since it is possible to determine the strength of pushing of the pedal 30 by the performer, an electronic musical tone with a timbre and a sound volume according to the strength of pushing can be produced from an external device (not shown).

Since the pedal 30 comes in contact with the first buffer component 73 of the sensor unit 70, a striking sound and shock according to the contact between the pedal 30 and the sensor unit 70 can be reduced by the first buffer component 73. Here, the elastic modulus of the first buffer component 73 is set such that a pressing force is applied to the pedal sensor 72 from the pedal 30 when the pedal 30 and the sensor unit 70 come in contact with each other.

The performer further pushes the pedal 30 in a state in which the pedal 30 and the sensor unit 70 are in contact with each other (a pressing force from the pedal 30 is applied to the pedal sensor 72). In this case, the first buffer component 73 and the second buffer component 76 are elastically deformed and rotation of the pedal 30 is allowed. Then, as shown in FIG. 6, the pedal 30 rotates to a position at which the second shaft 12, the third shaft 13 and the fourth shaft 14 are included in the same plane. Since the position at which the second shaft 12, the third shaft 13, and the fourth shaft 14 are included in the same plane is a dead point of the crank mechanism, it is structurally impossible to push the pedal 30 more. Therefore, the position at which the second shaft 12, the third shaft 13, and the fourth shaft 14 are included in the same plane is the lowermost position of the pedal 30.

At the initial position of the pedal 30, a distance between the second mounting part 42 and the first mounting part 27 (the length of the spring 60) is set to be the shortest. When the pedal 30 rotates from the initial position to the lowermost position, the second mounting part 42 rotates about 90° around the second shaft 12. According to setting in this manner, as the pedal 30 is closer to the lowermost position from the initial position (as the second mounting part 42 rotates), the second mounting part 42 can be separated from the first mounting part 27 (the length of the spring 60 can be increased).

Here, the length (27 mm at the initial position of the pedal 30 in the present embodiment) of the part in which the spring 60 functions (expands and contracts) as a spring is small compared to a distance between the first mounting part 27 and the second mounting part 42 (45 mm at the initial position of the pedal 30 in the present embodiment). However, an increase rate of the distance between the first mounting part 27 and the second mounting part 42 according to rotation of the pedal 30 is the same as an increase rate of the length of the part in which the spring 60 expands and contracts according to rotation of the pedal 30.

When an angle at which the second mounting part 42 rotates according to rotation of the pedal 30 from the initial position to the lowermost position is 180° or less, as the pedal 30 is closer to the lowermost position from the initial position, the second mounting part 42 can be separated from the first mounting part 27. Thereby, as the pedal 30 is closer to the lowermost position from the initial position, the urging force of the spring 60 can be increased. Therefore, as the pedal 30 is closer to the lowermost position, it is possible to reduce the kinetic energy of the pedal 30 by the spring 60. As a result, since shock and sound when rotation of the pedal 30 is stopped can be reduced, it is possible to improve sound damping performance when the pedal 30 is operated.

In addition, as the pedal 30 is closer to the lowermost position from the initial position, since the urging force of the spring 60 can be increased, a resistance (pedal reaction force) which increases according to a push amount of the pedal 30 from the initial position can be applied to the performer from the pedal 30. As a result, an operation feeling of the pedal 30 can be ensured.

Since the second mounting part 42 rotates around the second shaft 12, as the pedal 30 is closer to the lowermost position from the initial position, an increase rate of a distance (the length of the spring 60) between the first mounting part 27 and the second mounting part 42 can be increased. As a result, as shown in FIG. 7, it is possible to increase the pedal reaction force (the urging force of the spring 60) acceleratively and continuously in response to pushing of the pedal 30. That is, the shape of the graph A of the pedal device 10 is a relatively smooth curve from the initial position (the left end of the plane of the paper) to the lowermost position (the right end of the plane of the paper).

On the other hand, in the graph B of a conventional pedal device that strikes a struck part according to rotation of the pedal, a trend of an increase in the pedal reaction force sharply varies before and after a point C at which a struck part is struck. In the graph B, when a pedal angle exceeds the point C (before a struck part is struck), the pedal reaction force slightly increases according to the urging force of the spring for returning the pedal to the initial position. When the pedal is pushed and the pedal angle is smaller than the point C (a struck part is struck), rotation of the pedal stops according to striking (contacting) to the struck part. Therefore, a striking sound is generated and the pedal reaction force sharply increases according to contacting with the struck part.

In the pedal device 10, rotation of the pedal 30 is not stopped according to striking to the struck part as in a conventional pedal device. That is, in the pedal device 10, a rotation range of the pedal 30 is from the initial position to the lowermost position. Therefore, the pedal 30 can be rotated to a limit of pushing by the performer. Thus, since it is possible to prevent the pedal 30 from coming in contact with the struck part and a striking sound and shock from being generated as in the conventional pedal device, it is possible to improve sound damping performance when the pedal 30 is operated.

In addition, when the pedal device 10 uses the spring 60 having a larger spring constant than a spring of a conventional pedal device, it is possible to increase the pedal reaction force in the vicinity of the lowermost position. Thus, it is possible to sufficiently reduce a rotational speed of the pedal 30 before the pedal 30 reaches the lowermost position. As a result, since the pedal 30 rotates to the lowermost position and shock and sound when rotation of the pedal 30 is stopped can be reduced, it is possible to improve sound damping performance when the pedal 30 is operated. Here, in consideration of a balance between a force required to push the pedal 30 and a pedal reaction force in the vicinity of the lowermost position, it is possible to appropriately adjust the number of springs 60 and a spring constant of the spring 60.

Further, as an angle at which the second mounting part 42 rotates according to rotation of the pedal 30 from the initial position to the lowermost position becomes larger, an extension of the spring 60 increases. Thus, the urging force of the spring 60 in the vicinity of the lowermost position becomes larger and it is possible to increase the pedal reaction force in the vicinity of the lowermost position. Shock and sound when rotation of the pedal 30 is stopped at the lowermost position can be reduced and it is possible to improve sound damping performance when the pedal 30 is operated.

With respect to a distance from the second shaft 12 to the first mounting part 27 (65 mm in the present embodiment), as a distance from the second shaft 12 to the second mounting part 42 (20 mm in the present embodiment) is larger, an extension rate of the spring 60 according to a push amount of the pedal 30 can be increased. That is, as a value obtained by dividing a distance from the second shaft 12 to the first mounting part 27 by a distance from the second shaft 12 to the second mounting part 42 is smaller, an increase rate of the pedal reaction force according to a push amount of the pedal 30 can be increased. As a result, it is possible to increase the pedal reaction force in the vicinity of the lowermost position.

When a value (about 3.25 in the present embodiment) obtained by dividing a distance from the second shaft 12 to the first mounting part 27 by a distance from the second shaft 12 to the second mounting part 42 is set to 4 or less, it is possible to increase the pedal reaction force in the vicinity of the lowermost position. Thus, it is possible to sufficiently reduce a rotational speed of the pedal 30 before the pedal 30 reaches the lowermost position. As a result, shock and sound when rotation of the pedal 30 is stopped at the lowermost position can be reduced, and it is possible to improve sound damping performance when the pedal 30 is operated.

More preferably, a value obtained by dividing a distance from the second shaft 12 to the first mounting part 27 by a distance from the second shaft 12 to the second mounting part 42 is set to 3.5 or less. Most preferably, a value obtained by dividing a distance from the second shaft 12 to the first mounting part 27 by a distance from the second shaft 12 to the second mounting part 42 is set to 3.3 or less. In these cases, since the pedal reaction force in the vicinity of the lowermost position can be set to be larger, it is possible to further improve sound damping performance when the pedal 30 is operated.

In the pedal device 10, the first buffer component 73 and the second buffer component 76 are elastically deformed and rotation of the pedal 30 is allowed. Therefore, without disturbing rotation of the pedal 30 according to the first buffer component 73 and the second buffer component 76, the pedal sensor 72 can detect the fact that the pedal 30 has pushed by a predetermined amount. As a result, it is possible to improve sound damping performance when the pedal 30 is operated and the pedal sensor 72 can detect pushing of the pedal 30.

When the performer vigorously pushes the pedal 30, the rotation part 40 may exceed a position corresponding to the lowermost position of the pedal 30. In addition, when pushing of the pedal 30 is released, the rotation part 40 may exceed a position corresponding to the initial position of the pedal 30 by the urging force of the spring 60. Therefore, a predetermined gap is provided between the second mounting part 42 and both ends of the guide hole 23*c* at the initial position and the lowermost position of the pedal 30. Thus, even when the rotation part 40 exceeds positions corresponding to the initial position and the lowermost position of the pedal 30, if the excess length is less than the predetermined gap, the second mounting part 42 can be prevented from coming in contact with both ends of the guide hole 23*c*. Therefore, it is possible to ensure sound damping performance when the pedal 30 is operated.

In addition, when the rotation part 40 exceeds the position corresponding to the lowermost position of the pedal 30, the pedal 30 rotates from the lowermost position toward the initial position. Since the weight 35 is mounted on the pedal 30, a downward inertial force applied to the pedal 30 that has rotated to the lowermost position can be increased. According to the inertial force, it is difficult for the pedal 30 to rotate from the lowermost position to the initial position. As a result, it is difficult for the rotation part 40 to exceed the position corresponding to the lowermost position of the pedal 30.

Since the rotation part 40 slides with respect to the second shaft 12, it is possible to reduce the size of the rotation part 40 compared to when a bearing is provided between the rotation part 40 and the second shaft 12. Similarly, since the connection part 50 slides with respect to the third shaft 13 and the fourth shaft 14, it is possible to reduce the size of the connection part 50 compared to when a bearing is provided between the connection part 50, and the third shaft 13 and the fourth shaft 14.

Further, the rotation part 40 and the connection part 50 have a self lubricating property. Therefore, even if there is no bearing between the rotation part 40 and the second shaft 12, the rotation part 40 can relatively smoothly rotate (slide) around the second shaft 12. In addition, even if there is no bearing between the connection part 50, and the third shaft 13 and the fourth shaft 14, the connection part 50 can relatively smoothly rotate (slide) around the third shaft 13 and the fourth shaft 14. As a result, it is possible to smoothly rotate the rotation part 40 and the connection part 50 and it is possible to reduce the size of the rotation part 40 and the connection part 50. Here, in the pedal device 10, in response to pushing of the pedal 30 from the initial position, a resistance is applied to the performer from the pedal 30 according to the spring 60. Therefore, it is difficult for the performer to feel the resistance due to sliding between the rotation part 40 and the connection part 50, and the shafts 12, 13, and 14.

Next, a second embodiment will be described with reference to FIG. 8 to FIG. 11. The pedal device 10 used for an electronic instrument that simulates a percussion instrument such as a bass drum has been described in the first embodiment. On the other hand, in the second embodiment, a pedal device 100 used for an electronic instrument (an electronic high hat 80) that simulates a high hat cymbal will be described. Here, parts the same as in the first embodiment will be denoted with the same reference numerals and descriptions thereof will be omitted.

Figure 8:
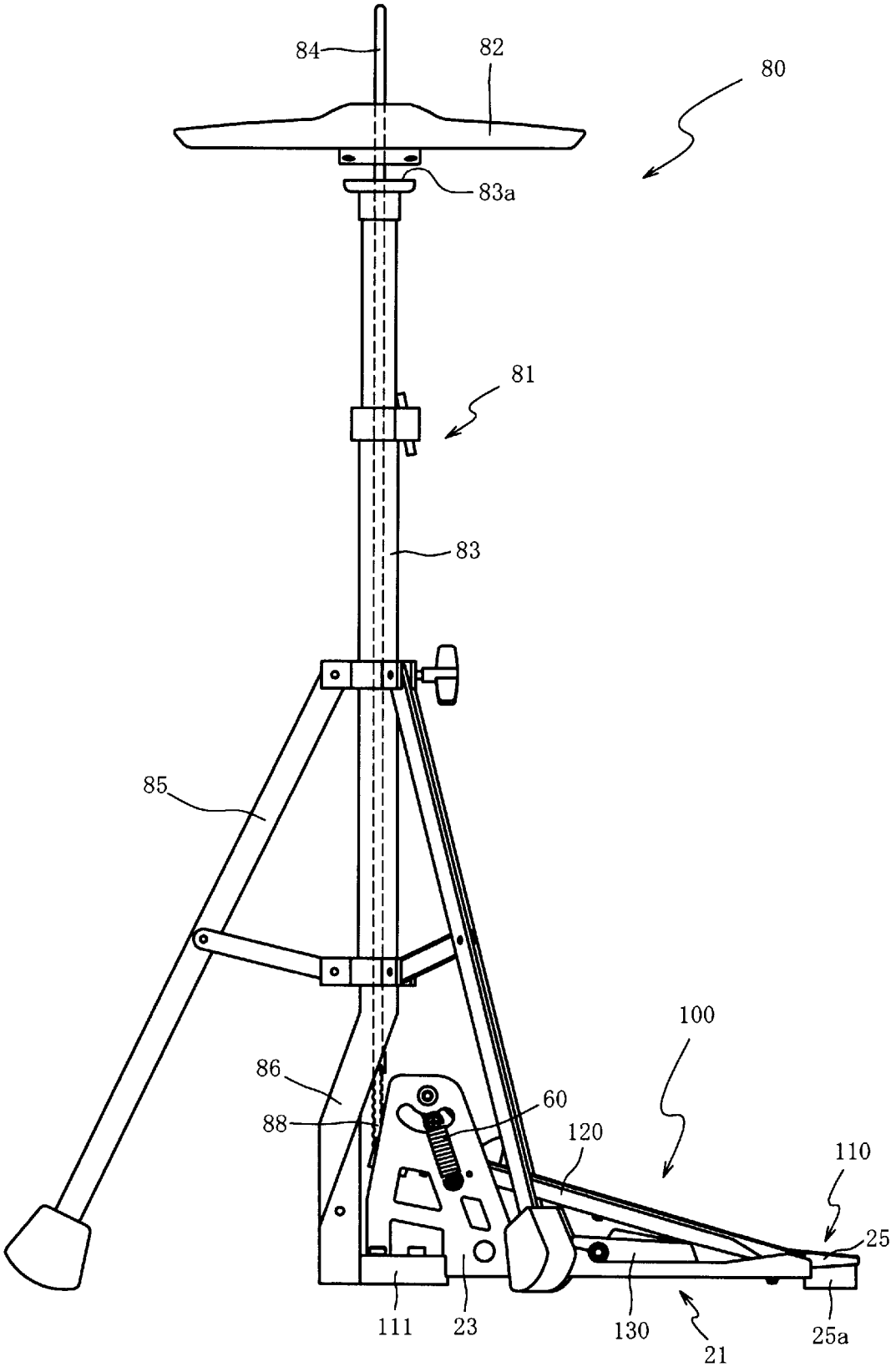
FIG. 8 is a side view of an instrument pedal device mounted on a high hat stand in a second embodiment.

First, the electronic high hat 80 will be described with reference to FIG. 8 and FIG. 9. FIG. 8 is a side view of the pedal device 100 mounted on a high hat stand 81 in the second embodiment. FIG. 8 is a perspective view of an enlarged part of the high hat stand 81. As shown in FIG. 8, the electronic high hat 80 is an electronic instrument that produces an electronic musical tone when a cymbal pad 82 mounted on the high hat stand 81 is struck. The electronic musical tone is produced when a sensor (not shown) provided at the cymbal pad 82 detects striking and the detection result is output to an external device (not shown).

Figure 9:
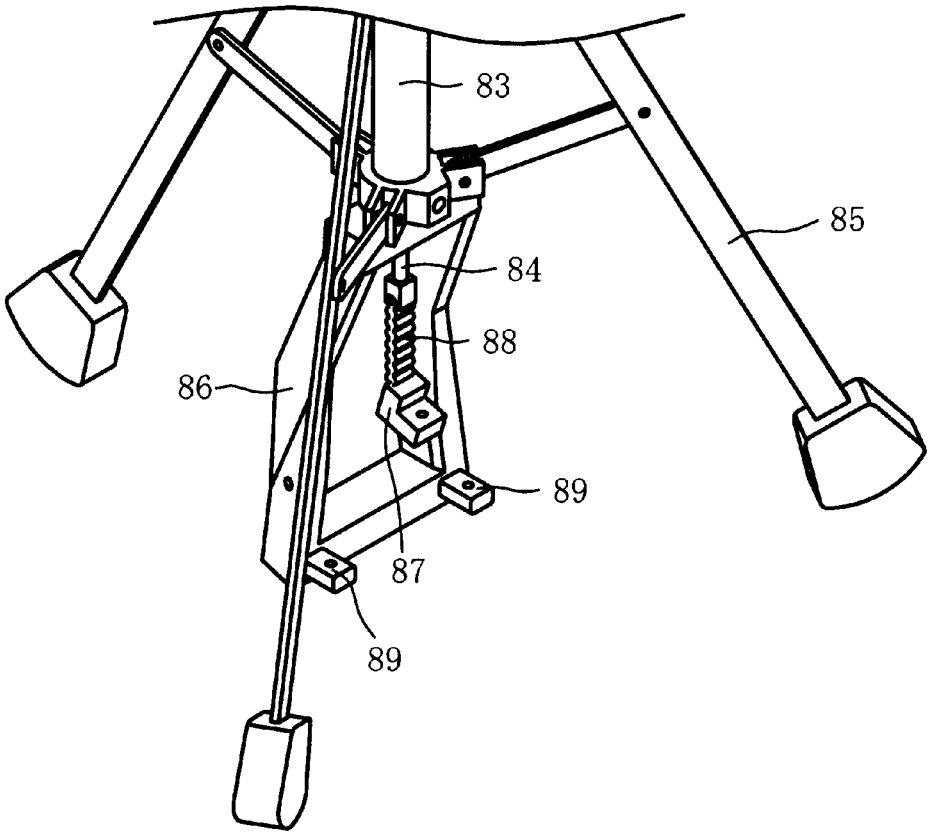
FIG. 9 is a perspective view of an enlarged part of the high hat stand.

As shown in FIG. 8 and FIG. 9, the high hat stand 81 includes a hollow shaft 83, a rod 84, a tripod 85, and a stand connector 86. The rod 84 is a part which is inserted into the hollow shaft 83 and to which the cymbal pad 82 is fixed. The tripod 85 is a part that supports the hollow shaft 83 in a self-standing manner. In the high hat stand 81, a lower end of the rod 84 and a rod mounting part 87 connected to the bolt hole 34 of a pedal 120 of the pedal device 100 are connected by a chain 88. Therefore, according to an operation of the pedal 120, the rod 84 and the cymbal pad 82 fixed to the rod 84 move up and down.

When the pedal 120 is pushed, the rod 84 and the cymbal pad 82 are lowered, and the cymbal pad 82 comes in contact with an upper part 83*a* of the hollow shaft 83. This state is called a closed state. On the other hand, when pushing of the pedal 120 is released, the rod 84 and the cymbal pad 82 are raised. This state is called an open state. In the acoustic high hat cymbal, a timbre of a musical tone according to striking differs in between the open state and the closed state.

The stand connector 86 is a part on which the pedal device 100 is mounted. The stand connector 86 is mounted on a lower part of the hollow shaft 83. The stand connector 86 is formed in two parts to correspond to the pair of side plates 23. In the stand connector 86, a protrusion 89 to be inserted into a rear ground part 111 of the pedal device 100 is provided.

Figure 10:
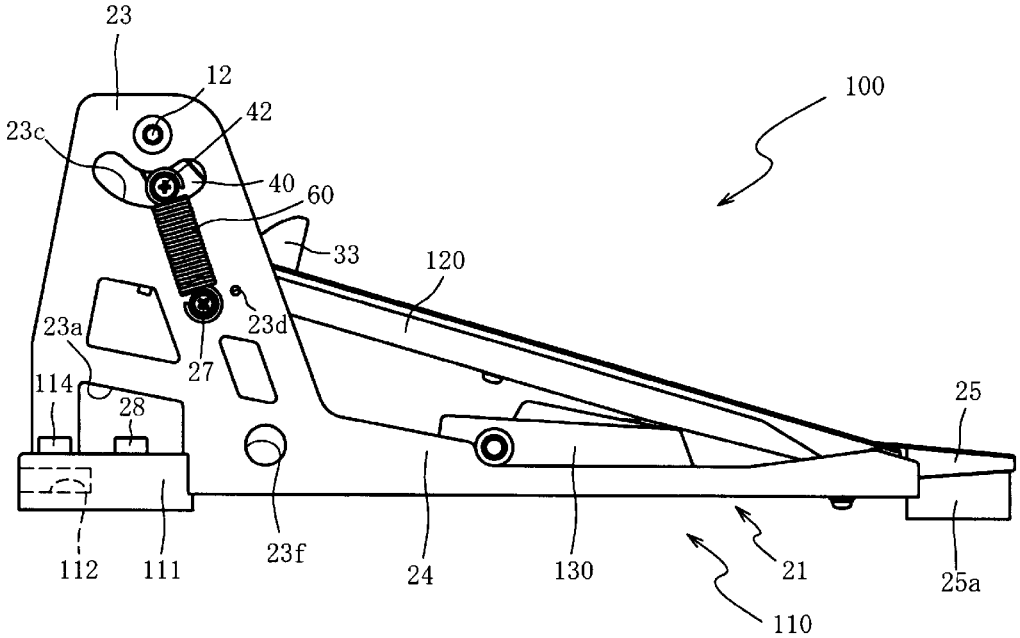
FIG. 10 is a side view of the instrument pedal device.
Figure 11:
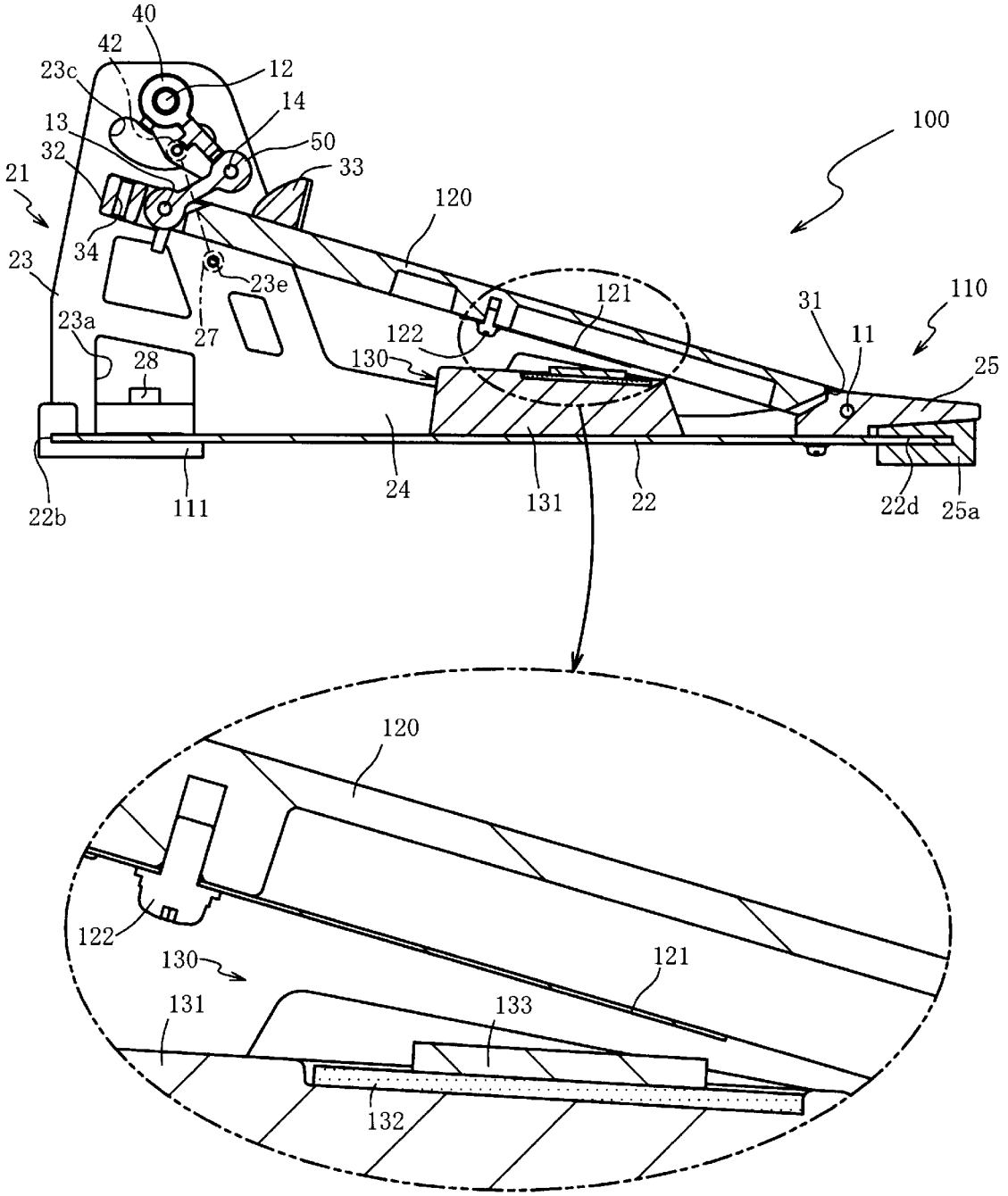
FIG. 11 is a cross-sectional view of the instrument pedal device.

Next, the pedal device 100 will be described with reference to FIG. 10 and FIG. 11. FIG. 10 is a side view of the pedal device 100. FIG. 11 is a cross-sectional view of the pedal device 100. As shown in FIG. 10 and FIG. 11, the pedal device 100 includes a base part 110, the pedal 120, the rotation part 40, the connection part 50, the spring 60, and a sensor unit 130.

The base part 110 is a member serving as a foundation of the pedal device 100 and is placed on the floor. The base part 110 is formed by mounting the front ground part 25 and the rear ground part 111 on the plate-like frame 21. In the present embodiment, the first mounting part 27 is mounted on the second mounting hole 23*e* of the side plate 23 of the frame 21.

The rear ground part 111 is a rubber member that receives a load on the rear side of the pedal device 100 and covers the leg 22*e*. The rear ground part 111 is inserted from the outside of the leg 22*e* in the left and right direction and the rear ground part 111 is inserted into the leg 22*e*. In this state, when the bolt 28 that penetrates through the leg 22*e* and the rear ground part 111 in the vertical direction is mounted, the rear ground part 111 is fixed to the leg 22*e*. In addition, an insertion hole 112 into which the protrusion 89 can be inserted is formed at a rear part of the rear ground part 111. While the protrusion 89 is inserted into the insertion hole 112, when a bolt 114 that penetrates through the insertion hole 112 and the protrusion 89 in the vertical direction is mounted, the stand connector 86 is fixed to the rear ground part 111. Thereby, the pedal device 100 is mounted on the high hat stand 81.

The pedal 120 is a member that rotates around the first shaft 11 when a foot of the performer is put on the front side and the performer performs a push operation. The pedal 120 is rotatably supported on the base part 110 by the first shaft 11. The pedal 120 is formed in a long plate shape that extends from the first end 31 to the second end 32. In the pedal 120, a plate member 121 (elastic body) is fixed to the back side by a bolt 122.

The plate member 121 is a rectangular metal member. The plate member 121 is mounted on the back side of the pedal 120 in a cantilever state in which an end fixed to the bolt 122 is set as a fixing end and an end on the side opposite to the fixing end is set as a free end. In the plate member 121, while the pedal 120 rotates from the initial position to the lowermost position, the sensor unit 130 (a buffer component 133) and the free end side come in contact with each other. When the plate member 121 and the sensor unit 130 come in contact with each other, the elastic modulus of the plate member 121 is set such that a pressing force is applied to the sensor unit 130 from the pedal 120 through the plate member 121.

The sensor unit 130 is a member for detecting an operation state of the pedal 120. The sensor unit 130 includes a main body 131, a pedal sensor 132, and the buffer component 133 (elastic body). The buffer component 133 is a plate-like member made of sponge. The buffer component 133 is adhered to a surface on the side of the pedal 120 of the pedal sensor 132.

The main body 131 is a member that is mounted on a surface on the side of the pedal 120 of the bottom panel 22. In the main body 131, an output terminal configured to output a detection result of the pedal sensor 132 to an external device (not shown) is provided. The pedal sensor 132 is a sheet-like pressure sensor including a membrane switch. The pedal sensor 132 is adhered to the main body 131, receives a pressing force from the pedal 120, and detects an operation state of the pedal 120. A resistance value of the pedal sensor 132 decreases as an area of the part pressed increases. Here, not only the pedal sensor 132 whose resistance value decreases as an area of the part pressed increases but also the pedal sensor 132 whose resistance value decreases as a pressing force becomes stronger can be used.

In the pedal device 100, when the performer pushes the pedal 120, the plate member 121 of the pedal 120 and the buffer component 133 of the sensor unit 130 come in contact with each other. If the performer further pushes the pedal 120 in a state in which the plate member 121 and the buffer component 133 are in contact with each other, the plate member 121 and the buffer component 133 are elastically deformed and rotation of the pedal 120 is allowed. Then, the pedal 120 rotates to the lowermost position.

In response to pushing of the pedal 120, the free end side of the plate member 121 in a cantilever state comes in contact with the buffer component 133. Therefore, as the pedal 120 is closer to the lowermost position, a contact area between the plate member 121 and the buffer component 133 becomes larger, and a pressing force per unit area from the plate member 121 to the buffer component 133 increases. Therefore, as the pedal 120 is closer to the lowermost position, an area in which a pressing force is applied to the pedal sensor 132 from the plate member 121 through the buffer component 133 becomes larger. Thus, a force (a force obtained by multiplying an area by the pressing force per unit area) with which the plate member 121 presses the pedal sensor 132 through the buffer component 133 increases. As a result, as the pedal 120 is closer to the lowermost position, since a resistance value of the pedal sensor 132 decreases, it is possible to determine an operation state (push amount) of the pedal 120 by the pedal sensor 132.

The pedal device 100 can determine a state in which no pressing force is applied to the pedal sensor 132 as an open state. In addition, a state in which a pressing force is applied to the pedal sensor 132 and a push amount of the pedal 120 is less than a predetermined value (a resistance value of the pedal sensor 132 is larger than a predetermined value) can be determined as a half open state. In addition, a state in which a pressing force is applied to the pedal sensor 132 and a push amount of the pedal 120 is equal to or larger than a predetermined value (a resistance value of the pedal sensor 132 is equal to or less than a predetermined value) can be determined as a closed state. Therefore, when the electronic high hat 80 on which the pedal device 100 is mounted is played, it is possible to produce an electronic musical tone with a timbre corresponding to each of the open state, the half open state, and the closed state.

Here, in the present embodiment, when the pedal 120 rotates to the lowermost position, the cymbal pad 82 is set to be in contact with the upper part 83*a* of the hollow shaft 83 (brought into the closed state). Thus, when the cymbal pad 82 is struck while the pedal 120 is pushed to the limit, since the cymbal pad 82 is in contact with the upper part 83*a* of the hollow shaft 83, the cymbal pad 82 does not easily fall down. As a result, it is possible to simulate a movement of the acoustic high hat cymbal in the closed state.

According to the pedal device 100 described above, since the sensor unit 130 is pressed on the free end side of the plate member 121 in a cantilever state, the plate member 121 can be easily elastically deformed. In addition, a pressing force to the sensor unit 130 can be ensured according to the restoring force of the elastically deformed plate member 121. As a result, it is possible to improve sound damping performance when the pedal 120 is operated and improve the detection sensitivity of the pedal sensor 132.

The first mounting part 27 is mounted on the second mounting hole 23*e*. Therefore, the initial position of the pedal 120 can be brought closer to the bottom panel 22 compared to the initial position of the pedal 30 in the first embodiment (when the first mounting part 27 is mounted on the first mounting hole 23*d*). Here, the lowermost position of the pedal 120 is the same as the lowermost position of the pedal 30 in the first embodiment. Thus, when the pedal 120 rotates from the initial position to the lowermost position, an angle at which the second mounting part 42 that rotates around the second shaft 12 rotates can be set to be smaller than 90°. As a result, a resistance applied to the performer from the pedal 120 at the lowermost position of the pedal 120 can be reduced. Thus, it is possible to reduce a pushing force pushing the pedal 120 to the lowermost position or maintaining the pedal 120 at the lowermost position.

Next, a third embodiment will be described with reference to FIG. 12. A case in which the pedal sensor 132 is pressed on the free end side of the plate member 121 fixed in a cantilever state to the back side of the pedal 120 has been described in the second embodiment. On the other hand, a case in which the pedal 30 comes in direct contact with a buffer component 142 and the pedal sensor 132 is pressed by the pedal 30 through the buffer component 142 will be described in the third embodiment. Here, parts the same as in the first and second embodiments will be denoted with the same reference numerals and descriptions thereof will be omitted.

Figure 12:
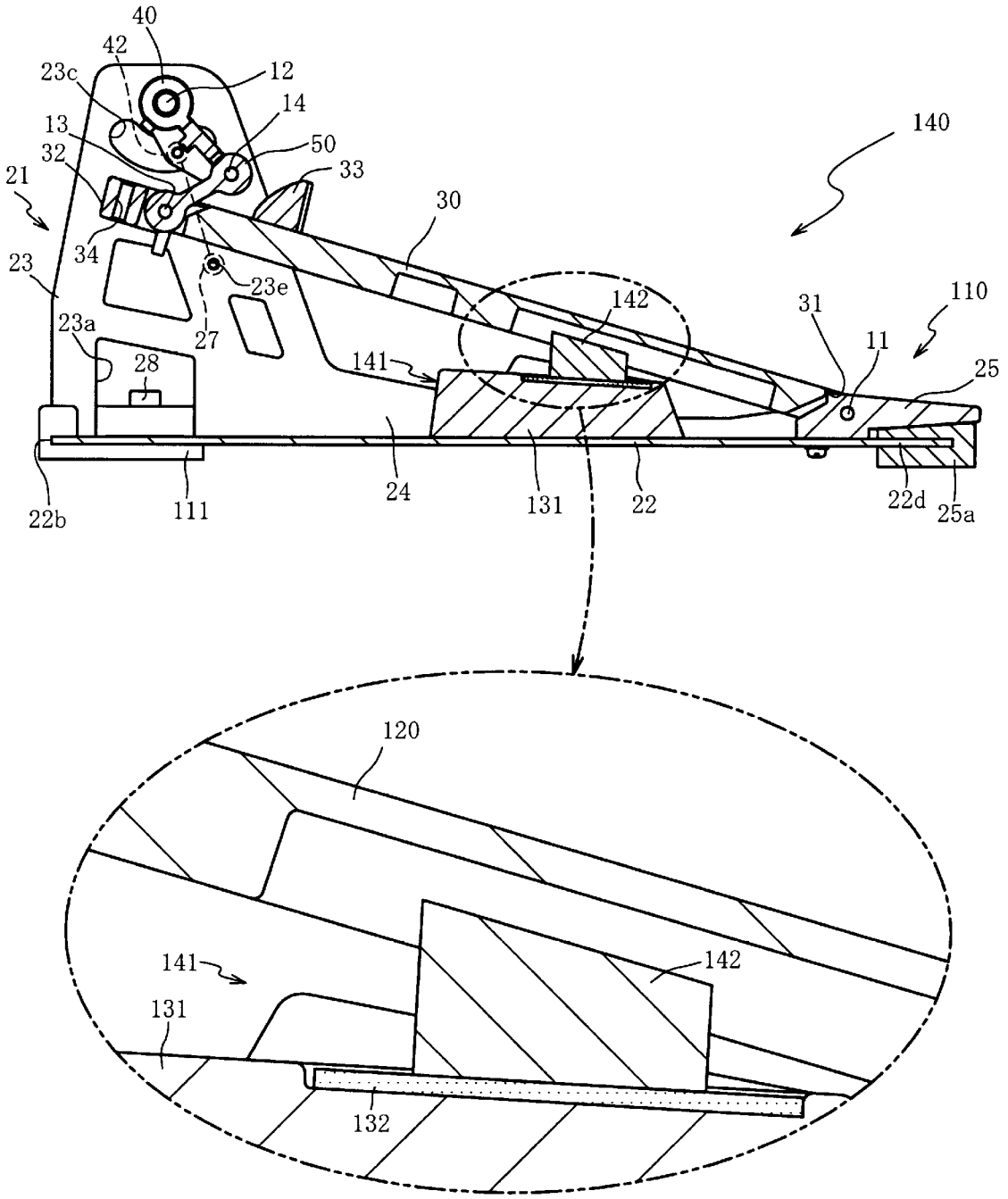
FIG. 12 is a cross-sectional view of an instrument pedal device in a third embodiment.

FIG. 12 is a cross-sectional view of a pedal device 140 in the third embodiment. As shown in FIG. 12, in a sensor unit 141 of the pedal device 140, the buffer component 142 (elastic body) is adhered to a surface on the side of the pedal 30 of the pedal sensor 132. The buffer component 142 is a member made of sponge. In the buffer component 142, a surface on the side of the pedal 30 is inclined to descend toward the first shaft 11 with respect to the pedal sensor 132. The elastic modulus of the buffer component 142 is set such that a pressing force is applied to the pedal sensor 132 from the pedal 30 through the buffer component 142 when the pedal 30 and the buffer component 142 come in contact with each other.

In the pedal device 140, when the performer pushes the pedal 30, the pedal 30 and the buffer component 142 come in contact with each other. When the performer further pushes the pedal 30 in a state in which the pedal 30 and the buffer component 142 are in contact with each other, the buffer component 142 is elastically deformed, rotation of the pedal 30 is allowed, and the pedal 30 rotates to the lowermost position.

In the buffer component 142, an inclination angle on a surface on the side of the pedal 30 is set such that a contact part with the pedal 30 becomes larger as the pedal 30 becomes closer to the lowermost position. Thereby, as the pedal 30 is closer to the lowermost position, an area in which a pressing force is applied to the pedal sensor 132 from the pedal 30 through the buffer component 142 becomes larger. Then, a force with which the pedal 30 presses the pedal sensor 132 through the buffer component 142 becomes larger. As a result, as the pedal 30 is closer to the lowermost position, since a resistance value of the pedal sensor 132 is reduced, the pedal sensor 132 can determine an operation state (push amount) of the pedal 30.

Next, a fourth embodiment will be described with reference to FIG. 13 to FIG. 15. The crank mechanism in which the third shaft 13 is positioned below the second shaft 12 has been described in the first embodiment. On the other hand, in the fourth embodiment, a crank mechanism in which the third shaft 13 is positioned above a second shaft 151 will be described. Here, parts the same as in the first embodiment will be denoted with the same reference numerals and descriptions thereof will be omitted.

First, a pedal device 150 when the pedal 30 is at the initial position will be described with reference to FIG. 13 and FIG. 14. FIG. 13 is a schematic diagram of the pedal device 150, which shows the initial position in the fourth embodiment. FIG. 14 is a schematic diagram of the pedal device 150 when viewed in an arrow XIV direction in FIG. 13. Here, FIG. 14 is a diagram in which the pedal 30 is omitted.

Figure 13:
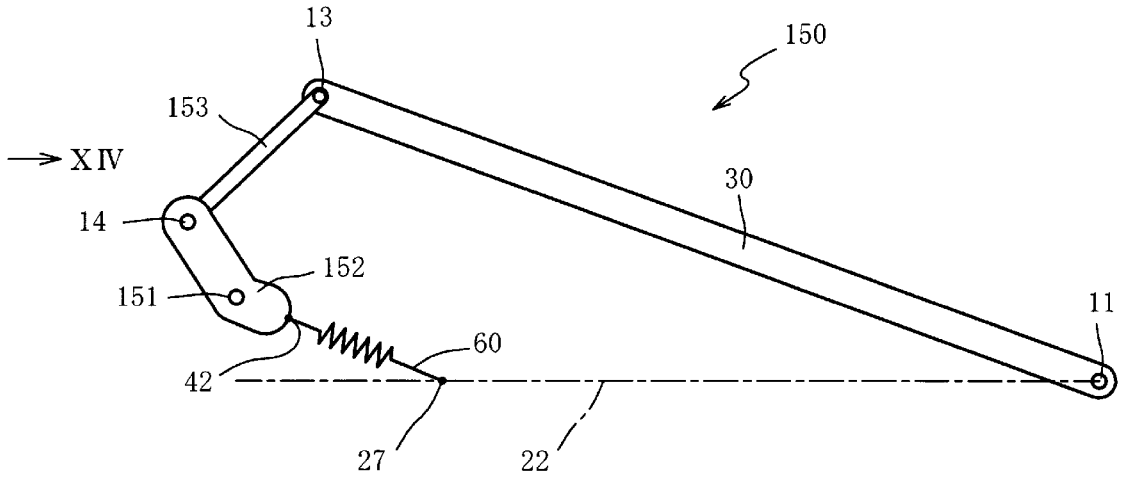
FIG. 13 is a schematic diagram of an instrument pedal device, which shows an initial position in a fourth embodiment.
Figure 14:
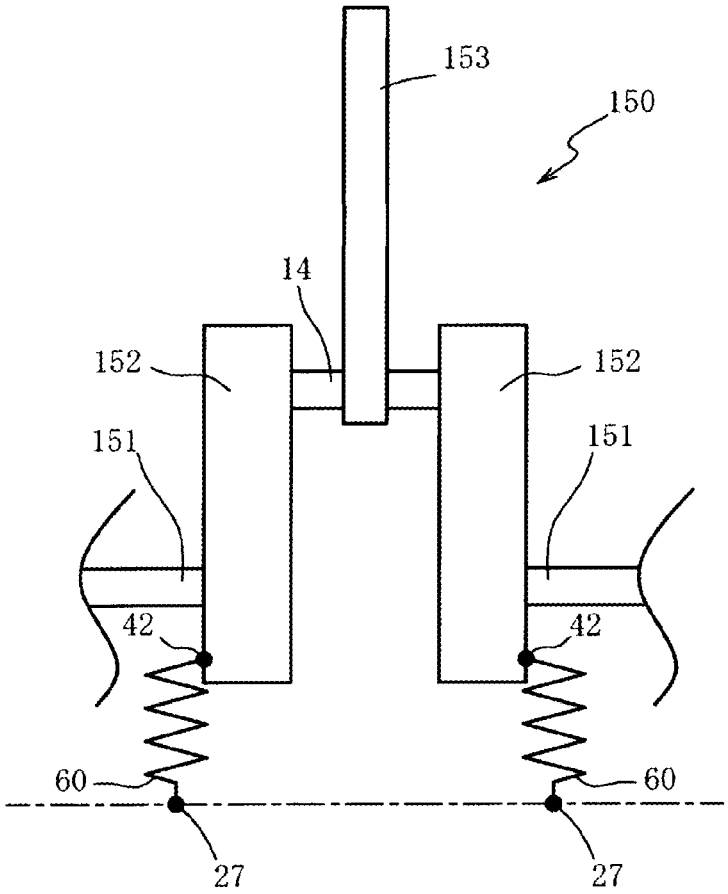
FIG. 14 is a schematic diagram of the instrument pedal device when viewed in an arrow XIV direction in FIG. 13.
Figure 15:
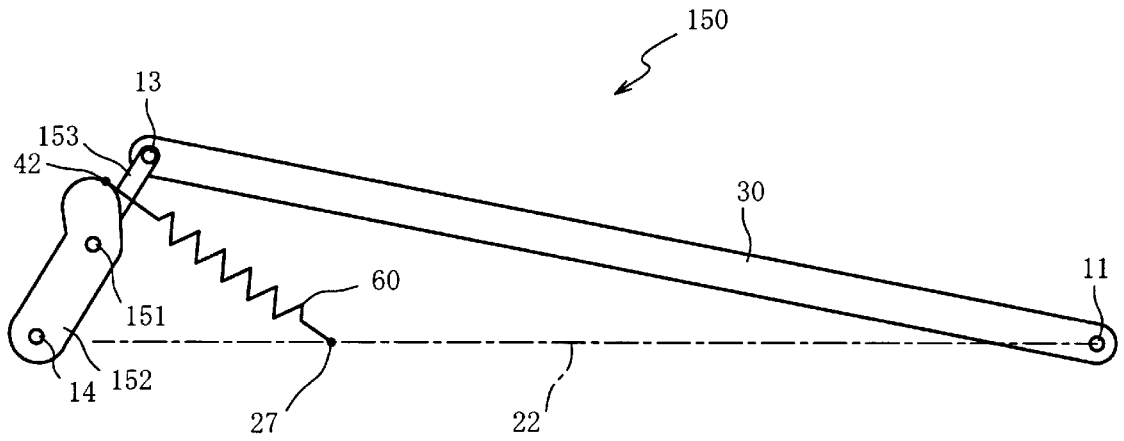
FIG. 15 is a schematic diagram of the instrument pedal device, which shows the lowermost position.

As shown in FIG. 13 and FIG. 14, the pedal device 150 includes the pedal 30, a rotation part 152, a connection part 153, and the spring 60. The rotation part 152 is rotatably supported on the side plate 23 (not shown in the present embodiment) that rises from the bottom panel 22 by the second shaft 151. The connection part 153 is rotatably supported on the pedal 30 by the third shaft 13. The connection part 153 is rotatably supported on the rotation part 152 by the fourth shaft 14. The first mounting part 27 on which the spring 60 is mounted is provided on the bottom panel 22. The third shaft 13, the fourth shaft 14, the second shaft 151, and the first shaft 11 are positioned in order from above.

The second shafts 151 are a pair of members that are divided into two parts in the axial direction. The second shaft 151 is rotatably supported on the side plate 23 that rises from the bottom panel 22. The rotation parts 152 are a pair of members to which both ends of the fourth shaft 14 are fixed. In the pair of rotation parts 152, ends of the second shafts 151 formed in a divided manner are fixed. The second shaft 151, the rotation part 152, and the fourth shaft 14 rotate integrally around the second shaft 151 in response to pushing of the pedal 30.

In the rotation part 152, the second mounting part 42 on which the spring 60 is mounted is provided at a predetermined distance from the second shaft 151. The second mounting part 42 is disposed so that the second shaft 151 is positioned between the second mounting part 42 and the fourth shaft 14. In the pedal device 150, at the initial position of the pedal 30, a distance from the second shaft 151 to the first mounting part 27 is set to 67 mm. In addition, at the initial position, a distance from the second shaft 151 to the second mounting part 42 is set to 17 mm.

The connection part 153 is a member that connects the pedal 30 and the rotation part 152 through the third shaft 13 and the fourth shaft 14. The connection part 153 is supported by the fourth shaft 14 between the pair of rotation parts 152. The connection part 153 is formed such that a distance between the third shaft 13 and the fourth shaft 14 is larger than a distance between the second shaft 151 and the fourth shaft 14.

Next, the pedal device 150 when the pedal 30 is at the lowermost position will be described with reference to FIG. 15. FIG. 15 is a schematic diagram of the pedal device 150, which shows the lowermost position. In the pedal device 150, when the performer pushes the pedal 30 at the initial position shown in FIG. 13, the connection part 153 is pushed downward. Then, the rotation part 152 rotates around the second shaft 151 in one direction (counterclockwise in FIG. 13). Therefore, as the pedal 30 is pushed from the initial position, the rotation part 152 and the connection part 153 are folded around the fourth shaft 14. Then, as shown in FIG. 15, the pedal 30 is pushed to a position at which the second shaft 151, the third shaft 13, and the fourth shaft 14 are included in the same plane.

Since the position at which the second shaft 151, the third shaft 13 and the fourth shaft 14 are included in the same plane is a dead point of the crank mechanism, it is structurally impossible to push the pedal 30 more. Therefore, the position at which the second shaft 151, the third shaft 13 and the fourth shaft 14 are included in the same plane is the lowermost position of the pedal 30. In the pedal device 150, since the pedal 30 can be rotated to a limit of pushing by the performer, as in the first embodiment, it is possible to improve sound damping performance when the pedal 30 is operated.

While the present invention has been described above based on the embodiments, the present invention is not limited to the above embodiments. It can be easily understood that various improvements and modifications can be made without departing from the spirit and scope of the present invention. For example, it should be noted that shapes of the base parts 20 and 110, the pedal 30, the rotation parts 40 and 152, the connection parts 50 and 153, and the like are only examples, and various shapes can be used.

While a case in which the spring 60 is a tension coil spring has been described in the above embodiments, the present invention is not necessarily limited thereto. Of course, a tension spring other than the tension coil spring can be used as the spring 60. In addition, without limitation to the tension spring, a compression spring can be used as the spring 60. In this case, the compression spring is set to be the longest at the initial position. In addition, the torsion spring is used as the spring 60 and can return the pedals 30 and 120 to the initial position. Here, the spring 60 is not limited to a spring made of a metal, but a spring made of rubber or a thermoplastic elastomer can be used.

While a case in which a position at which the first mounting part 27 is mounted is selected from the first mounting hole 23*d* or the second mounting hole 23*e* has been described in the first, second, and third embodiments, the present invention is not necessarily limited thereto. A mounting hole is provided in addition to the first mounting hole 23*d* and the second mounting hole 23*e*, and the first mounting part 27 can be mounted on the mounting hole. In addition, a hole, a projection, or the like provided in the side plate 23 can be set as the first mounting part. When the position of the first mounting part is adjusted, the initial position of the pedal 30 can be appropriately changed.

A case in which the pedal sensor 72 is a vibration sensor including a piezoelectric sensor has been described in the first embodiment. A case in which the pedal sensor 132 is a pressure sensor including a membrane switch has been described in the second and third embodiments. However, the present invention is not necessarily limited thereto. Of course, other vibration sensors and pressure sensors can be used. In addition, a pressure sensor can be used in the first embodiment. When the pedal sensor 72 is a vibration sensor, it detects an operation state of the pedal 30 when the pedal sensor 72 starts to receive a pressing force from the pedal 30. On the other hand, when the pedal sensor 72 is a pressure sensor, it can detect an operation state of the pedal 30 while the pedal sensor 72 receives a pressing force from the pedal 30. Therefore, when the pedal sensor 72 is a pressure sensor, it can more accurately detect the strength of pushing of the pedal 30 and release of pushing of the pedal 30.

While a case in which the sensor units 70, 130, and 141 are mounted on a surface on the side of the pedals 30 and 120 of the bottom panel 22 has been described in the first, second, and third embodiments, the present invention is not necessarily limited thereto. Of course, the sensor units 70, 130, and 141 can be mounted on the pedals 30 and 120. In addition, the sensor units 70, 130, and 141 can be mounted on the side plate 23. Also in this case, the second buffer component 76 is disposed between the side plate 23 and the pedal sensor 72. Therefore, it is possible to reduce a vibration and shock transmitted from the side plate 23 to the pedal sensor 72, and erroneous detection of the pedal sensor 72 can be reduced.

A case in which the rotation part 40 and the connection part 50 are made of a composite material obtained by combining glass fibers with a nylon resin (polyamide) has been described in the first embodiment. However, the present invention is not necessarily limited thereto. The material of the rotation part 40 and the connection part 50 can be appropriately changed as long as the material has the strength and rigidity to withstand pushing of the pedal 30.

In addition, the material of the rotation part 40 and the connection part 50 is preferably a material having a self lubricating property. A synthetic resin has a self lubricating property when it has high crystallinity. In addition to a nylon (polyamide), examples of a synthetic resin having a self lubricating property include a polyacetal, a polytetrafluoroethylene, and a polyolefin. In addition, examples of a material having a self lubricating property other than the synthetic resin include graphite, molybdenum disulfide, and silver. Here, when a grease is used between the rotation part 40 and the connection part 50, and the shafts 12, 13, and 14, the rotation part 40 and the connection part 50 can be formed of a material other than the material having a self lubricating property.

A case in which the first shaft 11 and the third shaft 13 are fixed to the pedal 30, the second shaft 12 is fixed to the side plate 23, and the fourth shaft 14 is fixed to the rotation part 40 has been described in the first embodiment. However, the present invention is not necessarily limited thereto. Of course, the first shaft 11 can be fixed to the front ground part 25 (the base part 20), the second shaft 12 can be fixed to the rotation part 40, and the third shaft 13 and the fourth shaft 14 can be fixed to the connection part 50. Here, the shafts 11, 12, 13, and 14 are not fixed, a flange and a pin are provided at both ends of the shafts 11, 12, 13, and 14, and the shafts 11, 12, 13, and 14 can be removed when the pedal device 10 is operated.

A case in which the second mounting part 42 is inserted into the guide hole 23*c* provided at the side plate 23, and an end of the second mounting part 42 protrudes to the outside from a gap between the pair of side plates 23 has been described in the first embodiment. However, the present invention is not necessarily limited thereto. A notch can be provided in place of the guide hole 23*c*. Here, the shape of the notch can be appropriately set such that the second mounting part 42 that moves according to rotation of the pedal 30 does not contact with the side plate 23.

While a case in which the sheet metal 75 is provided between the double-sided adhesive tape 74 and the second buffer component 76 has been described in the first embodiment, the present invention is not necessarily limited thereto. Of course, a plate made of a resin or a ceramic and having a predetermined rigidity (having a higher rigidity than the first buffer component 73 and the second buffer component 76) can be provided between the double-sided adhesive tape 74 and the second buffer component 76.

While a case in which the second shaft 151, the rotation part 152, and the fourth shaft 14 rotate integrally has been described in the fourth embodiment, the present invention is not necessarily limited thereto. Of course, the second shaft 151 can be fixed to the side plate 23 and the rotation part 152 can be rotatably supported on the second shaft 151. In this case, it is preferable that the second shaft 151 be not divided in the axial direction in order to ensure the strength of the second shaft 151. Here, it is necessary to bend and turn the second shaft 151 and the connection part 153 such that the second shaft 151 and the connection part 153 do not come in contact with each other at the lowermost position of the pedal 30.

Here, the crank mechanism (a configuration in which the second shafts 12 and 151, the third shaft 13 and the fourth shaft 14 are included in the same plane at the lowermost position of the pedals 30 and 120) of the embodiments is not limited to the pedal device including the base parts 20 and 110 (the frame 21) of the embodiments, but it can be applied to a pedal device including base parts (frame) having various shapes. For example, a base part (frame) in which the second shafts 12 and 151 are hung on a pair of supports and the pair of supports and the front ground part 25 are connected at a rod-like bottom part is exemplified.

In addition, the base parts 20 and 110 (the frame 21) of the embodiments are not limited to the pedal device of the crank mechanism, but it can be applied to a pedal device having a chain or belt mechanism. In addition, the base parts 20 and 110 (the frame 21) of the embodiments are not limited to a pedal device used for an electronic instrument, but it can be applied to a pedal device used for an acoustic percussion instrument.

The invention claimed is:

1. An instrument pedal device comprising:

a base part placed on a floor;

a pedal, a first end side of the pedal is rotatably supported on the base part by a first shaft in a rotatable range of an initial position to a lowermost position;

a rotation part rotatably supported on the base part by a second shaft parallel to the first shaft;

a connection part rotatably supported on a second end side of the pedal by a third shaft parallel to the first shaft, and rotatably supported on the rotation part by a fourth shaft parallel to the first shaft; and a biasing member applying an urging force to the pedal that has rotated from the initial position to return to the initial position, wherein the second shaft, the third shaft, and the fourth shaft are included in the same plane at the lowermost position, wherein the urging force of the biasing member becomes larger as the pedal becomes closer to the lowermost position from the initial position, and wherein when the pedal is at the initial position, the fourth shaft is positioned on the side of the first shaft with respect to a plane including the second shaft and the third shaft.

2. The instrument pedal device according to claim 1, comprising:

a pedal sensor that receives a pressing force from the pedal during rotation from the initial position to the lowermost position and detects an operation state of the pedal; and an elastic body that allows rotation of the pedal to the lowermost position from a state in which a pressing force from the pedal is applied to the pedal sensor according to elastic deformation.

3. The instrument pedal device according to claim 2, wherein the elastic body includes a first buffer component positioned between the pedal and the pedal sensor, and a second buffer component positioned between the pedal sensor and the base part.

4. The instrument pedal device according to claim 2, wherein the pedal sensor is a pressure sensor in which detection values change according to a pressing force, and wherein the elastic body is provided between the pedal and the pedal sensor and has an elastic modulus with which a force pressing the pedal sensor becomes larger as the pedal becomes closer to the lowermost position.

* * * * *